US012435514B2

(12) United States Patent
Zheng et al.

(10) Patent No.: US 12,435,514 B2
(45) Date of Patent: Oct. 7, 2025

(54) ADHESIVE-LESS ROOFING SYSTEMS AND RELATED METHODS

(71) Applicant: BMIC LLC, Dallas, TX (US)

(72) Inventors: Yan Zheng, Parisippany, NJ (US); Joshua Tingley, Morris Plains, NJ (US); Yixi Xiao, Parsippany, NJ (US)

(73) Assignee: BMIC LLC, Dallas, TX (US)

( * ) Notice: Subject to any disclaimer, the term of this patent is extended or adjusted under 35 U.S.C. 154(b) by 0 days.

(21) Appl. No.: 18/736,287

(22) Filed: Jun. 6, 2024

(65) Prior Publication Data

US 2024/0410173 A1 Dec. 12, 2024

Related U.S. Application Data

(60) Provisional application No. 63/506,546, filed on Jun. 6, 2023.

(51) Int. Cl.
*E04D 5/08* (2006.01)

(52) U.S. Cl.
CPC ..... *E04D 5/08* (2013.01)

(58) Field of Classification Search
CPC .... E04D 5/00; E04D 5/02; E04D 5/08; E04D 5/10; E04D 7/00; E04D 11/02; E04D 11/00
See application file for complete search history.

(56) References Cited

U.S. PATENT DOCUMENTS 4,520,051 A 5/1985 Harrison
4,668,315 A 5/1987 Brady et al.
5,356,980 A 10/1994 Feder et al.
5,733,947 A 3/1998 Loiselle et al.
5,763,014 A 6/1998 Pickett
5,899,026 A 5/1999 Williams et al.
5,979,131 A 11/1999 Remmele et al.
6,401,401 B1 6/2002 Williams
6,437,071 B1 8/2002 Odaka et al.
6,613,816 B2 9/2003 Mahdi et al.
(Continued)

FOREIGN PATENT DOCUMENTS

CA 2868542 A1 * 7/2009 ..... C03C 1/026
CA 2532602 C 11/2013
(Continued)

OTHER PUBLICATIONS

Roofscout, How to Install a Liquid Overlay System on a Flat Roof (Arboflex PU), Nov. 16, 2022, https://www.youtube.com/watch?v=ZnAhhe71VO0 (Year: 2022).*
(Continued)

*Primary Examiner* — Theodore V Adamos
(74) *Attorney, Agent, or Firm* — GREENBERG TRAURIG, LLP

(57) ABSTRACT

Adhesive-less roofing systems are provided. A roofing system comprises a roofing substrate and at least two roofing membranes. The at least two roofing membranes are located on the roofing substrate. The at least two roofing membranes are partially overlapping, so as to form an overlapping portion. Each of the at least two roofing membranes independently comprises a crosslinked polymer and a boron-containing compound. Related roofing materials and related methods, among other things, are also provided.

14 Claims, 6 Drawing Sheets

(56) References Cited

U.S. PATENT DOCUMENTS

| | | | |
|---|---|---|---|
| 6,868,643 | B1 | 3/2005 | Williams |
| 6,887,964 | B2 | 5/2005 | Frisch et al. |
| 7,317,051 | B2 | 1/2008 | Georgeau et al. |
| 7,410,703 | B2 | 8/2008 | Giraud et al. |
| 7,510,768 | B2 | 3/2009 | Crawford et al. |
| 7,605,203 | B2 | 10/2009 | Feng et al. |
| 7,662,221 | B2 | 2/2010 | Fay |
| 7,767,308 | B2 | 8/2010 | Georgeau et al. |
| 7,807,752 | B2 | 10/2010 | Masutani et al. |
| 8,022,149 | B2 | 9/2011 | Udea et al. |
| 8,092,858 | B2 | 1/2012 | Smith |
| 8,142,856 | B2 | 3/2012 | Chevalier |
| 8,178,160 | B2 | 5/2012 | Ferencz et al. |
| 8,344,087 | B2 | 1/2013 | Maton et al. |
| 8,362,124 | B2 | 1/2013 | Rajaraman et al. |
| 8,372,515 | B2 | 2/2013 | Byrne et al. |
| 8,551,611 | B2 | 10/2013 | Pichler |
| 8,735,524 | B2 | 5/2014 | Lai et al. |
| 8,846,822 | B2 | 9/2014 | Yano et al. |
| 8,937,141 | B2 | 1/2015 | Sumi et al. |
| 8,974,627 | B2 | 3/2015 | Schubert et al. |
| 8,993,706 | B2 | 3/2015 | Schubert et al. |
| 9,102,799 | B2 | 8/2015 | Bloomfield |
| 9,156,981 | B2 | 10/2015 | Lim et al. |
| 9,169,393 | B2 | 10/2015 | Rungta et al. |
| 9,228,112 | B2 | 1/2016 | Gorodisher et al. |
| 9,243,152 | B2 | 1/2016 | Iyer et al. |
| 9,315,688 | B2 | 4/2016 | Yanan et al. |
| 9,328,259 | B1 | 5/2016 | Andrews |
| 9,334,433 | B2 | 5/2016 | Oertli et al. |
| 9,458,319 | B2 | 10/2016 | Maliverney et al. |
| 9,499,677 | B2 | 11/2016 | Dukes et al. |
| 9,523,022 | B2 | 12/2016 | Johnson et al. |
| 9,701,868 | B2 | 7/2017 | Iezzi |
| 9,745,489 | B2 | 8/2017 | Swift et al. |
| 9,828,523 | B2 | 11/2017 | Johnson et al. |
| 9,850,165 | B2 | 12/2017 | Dandekar et al. |
| 9,882,082 | B2 | 1/2018 | Kreutz et al. |
| 9,896,601 | B2 | 2/2018 | Setzke |
| 9,914,842 | B2 | 3/2018 | Bauer et al. |
| 9,919,972 | B2 | 3/2018 | Land et al. |
| 9,987,120 | B2 | 6/2018 | Soletti et al. |
| 9,993,786 | B2 | 6/2018 | Roland et al. |
| 10,087,278 | B2 | 10/2018 | Lobert et al. |
| 10,100,068 | B2 | 10/2018 | Burckhardt et al. |
| 10,138,394 | B2 | 11/2018 | Huda et al. |
| 10,266,773 | B2 | 4/2019 | Brooks et al. |
| 10,269,477 | B2 | 4/2019 | Matsutomi et al. |
| 10,301,422 | B2 | 5/2019 | Kramer et al. |
| 10,308,552 | B2 | 6/2019 | Dubey et al. |
| 10,308,771 | B2 | 6/2019 | Gao et al. |
| 10,351,690 | B2 | 7/2019 | Bardin et al. |
| 10,370,563 | B2 | 8/2019 | Tao et al. |
| 10,392,480 | B2 | 8/2019 | Cannas et al. |
| 10,400,134 | B2 | 9/2019 | Tatley et al. |
| 10,414,875 | B2 | 9/2019 | Cannas et al. |
| 10,428,252 | B2 | 10/2019 | Burckhardt et al. |
| 10,550,286 | B2 | 2/2020 | West |
| 10,550,575 | B2 | 2/2020 | Tang et al. |
| 10,570,243 | B2 | 2/2020 | Lim et al. |
| 10,577,801 | B2 | 3/2020 | Tselepis |
| 10,661,503 | B2 | 5/2020 | Monroe et al. |
| 10,717,821 | B2 | 7/2020 | Dei Santi et al. |
| 10,745,523 | B2 | 8/2020 | Scheim et al. |
| 10,759,946 | B2 | 9/2020 | Haberle et al. |
| 10,800,885 | B2 | 10/2020 | Fiedel et al. |
| 10,829,585 | B2 | 11/2020 | Becquet et al. |
| 10,867,720 | B2 | 12/2020 | Hayes et al. |
| 10,889,682 | B2 | 1/2021 | Damke et al. |
| 10,898,606 | B2 | 1/2021 | Stein et al. |
| 10,899,926 | B2 | 1/2021 | Kasemi et al. |
| 10,920,078 | B2 | 2/2021 | Grasmann et al. |
| 10,995,074 | B2 | 5/2021 | Cannas et al. |
| 11,021,611 | B2 | 6/2021 | Young |
| 11,097,259 | B2 | 8/2021 | Cannas et al. |
| 11,104,762 | B2 | 8/2021 | Hayes et al. |
| 11,242,463 | B2 | 2/2022 | Virtanen et al. |
| 11,292,771 | B2 | 4/2022 | Cannas et al. |
| 11,383,886 | B2 | 7/2022 | Cavallin et al. |
| 11,434,372 | B2 | 9/2022 | Verosky et al. |
| 11,591,798 | B2 | 2/2023 | Geyer et al. |
| 2001/0004490 | A1 | 6/2001 | Wait |
| 2004/0188016 | A1 | 9/2004 | Mahdi et al. |
| 2007/0160766 | A1 | 7/2007 | Copland |
| 2009/0137711 | A1 | 5/2009 | Georgeau et al. |
| 2010/0247929 | A1 | 9/2010 | Oertli et al. |
| 2013/0102738 | A1 | 4/2013 | Stanjek et al. |
| 2015/0218334 | A1 | 8/2015 | Halbach et al. |
| 2015/0337534 | A1* | 11/2015 | Miller ..... C08G 18/4825 52/309.3 |
| 2018/0016791 | A1 | 1/2018 | Tselepis |
| 2020/0181911 | A1 | 6/2020 | Tselepis |
| 2020/0270866 | A1 | 8/2020 | Yancey et al. |
| 2020/0339759 | A1 | 10/2020 | Tepe et al. |
| 2021/0079168 | A1 | 3/2021 | Spera |
| 2021/0095467 | A1* | 4/2021 | Zheng ..... E04B 7/18 |
| 2021/0179864 | A1* | 6/2021 | Khan ..... B05D 7/06 |
| 2022/0267654 | A1 | 8/2022 | Zheng et al. |
| 2022/0307263 | A1 | 9/2022 | Chich et al. |
| 2022/0325526 | A1* | 10/2022 | Geyer ..... B32B 9/043 |

FOREIGN PATENT DOCUMENTS

| | | | | |
|---|---|---|---|---|
| CA | 3067607 | A1 | 7/2020 | |
| CN | 104449439 | A | 3/2015 | |
| CN | 113980609 | A | 1/2022 | |
| EP | 1650261 | A1 | 4/2006 | |
| EP | 1987108 | B1 | 9/2009 | |
| EP | 2119745 | A1 | 11/2009 | |
| EP | 2072577 | B1 | 8/2010 | |
| EP | 2046909 | B1 | 10/2011 | |
| EP | 3166985 | A1 * | 5/2017 | ..... C08G 18/10 |
| KR | 101116662 | * | 3/2012 | |
| WO | 2020176861 | A1 | 9/2020 | |
| WO | WO-2021046280 | A1 * | 3/2021 | ..... B05D 1/02 |
| WO | 2021158579 | A1 | 8/2021 | |
| WO | 2022051492 | A1 | 3/2022 | |
| WO | 2023114489 | A1 | 6/2023 | |

OTHER PUBLICATIONS

Henry, Henry Pro-Grade Silicone Roof Coating System, Jul. 2017, obtained from https://henry.com/fileadmin/pdf/literature/HEN-Pro-GradeSiliconeAppGuide.pdf (Year: 2017).*

Knickerbocker, Liquid Roof Coatings vs. Liquid Membrane Coatings, Dec. 15, 2020, https://www.knickroof.com/blog/liquid-roof-coatings-vs-liquid-membrane-coatings/ (Year: 2020).*

Zhao et al., "Study on Optimization of Damping Performance and Damping Temperature Range of Silicone Rubber by Polyborosiloxane Gel", Polymers 2020, 12, 1196.

* cited by examiner

ADHESIVE-LESS ROOFING SYSTEMS AND RELATED METHODS

CROSS-REFERENCE TO RELATED APPLICATIONS

This application claims priority to U.S. Provisional Patent Application No. 63/506,546, filed Jun. 6, 2023, and titled "ADHESIVE-LESS ROOFING SYSTEMS AND RELATED METHODS"; the disclosure of which application is hereby incorporated herein by reference in its entirety.

FIELD

This disclosure generally relates to adhesive-less roofing systems and related methods.

BACKGROUND

Installation of roofing membranes is a laborious and time-intensive process. The tasks involved in the installation of roofing membranes is tedious and complicated. Roofing membranes thus are expensive to install.

SUMMARY

Some embodiments relate to a roofing system. In some embodiments, the roofing system comprises a roofing substrate. In some embodiments, the roofing system comprises at least two roofing membranes. In some embodiments, the at least two roofing membranes are located on the roofing substrate. In some embodiments, the at least two roofing membranes are partially overlapping, so as to form an overlapping portion. In some embodiments, each of the at least two roofing membranes independently comprises a crosslinked polymer. In some embodiments, each of the at least two roofing membranes independently comprises 1% to 30% by weight of a boron-containing compound based on a total weight of each of the at least two roofing membranes.

In some embodiments, the roofing substrate comprises at least one of a roof deck, an underlayment, or any combination thereof.

In some embodiments, the at least two roofing membranes are directly adhered to each other in the overlapping portion.

In some embodiments, an adhesive is not located between the at least two roofing membranes in the overlapping portion.

In some embodiments, the at least two roofing membranes are not heat welded together in the overlapping portion.

In some embodiments, a peel strength between the at least two roofing membranes in the overlapping portion is 1 PLI to 20 PLI as measured according to ASTM D413.

In some embodiments, the crosslinked polymer comprises at least one of a polysiloxane, a silyl-terminated polymer, or any combination thereof.

In some embodiments, the boron-containing compound comprises at least one of a boric acid, a boronic acid, a pyroboric acid, a boronate ester, a borate ester, a borosiloxane oligomer, a borosiloxane polymer, a boric anhydride, a boride, or any combination thereof.

In some embodiments, at least one of the at least two roofing membranes is a liquid applied roofing membrane.

In some embodiments, at least one of the at least two roofing membranes is a roofing accessory.

Som embodiments relate to a roofing system. In some embodiments, the roofing system comprises a roofing substrate. In some embodiments, the roofing system comprises at least three roofing membranes. In some embodiments, the at least three roofing membranes are located on the roofing substrate. In some embodiments, the at least three roofing membranes are partially overlapping, so as to form an overlapping portion. In some embodiments, each of the at least three roofing membranes independently comprises a crosslinked polymer. In some embodiments, each of the at least three roofing membranes independently comprises 1% to 30% by weight of a boron-containing compound based on a total weight of each of the at least three roofing membranes.

In some embodiments, the roofing substrate comprises at least one of a roof deck, an underlayment, or any combination thereof.

In some embodiments, the at least three roofing membranes are directly adhered to each other in the overlapping portion.

In some embodiments, an adhesive is not located between the at least three roofing membranes in the overlapping portion.

In some embodiments, the at least three roofing membranes are not heat welded to each other in the overlapping portion.

In some embodiments, a peel strength between the at least three roofing membranes in the overlapping portion is 1 PLI to 20 PLI as measured according to ASTM D413.

In some embodiments, the crosslinked polymer comprises at least one of a polysiloxane, a silyl-terminated polymer, or any combination thereof.

In some embodiments, the boron-containing compound comprises at least one of a boric acid, a boronic acid, a pyroboric acid, a boronate ester, a borate ester, a borosiloxane oligomer, a borosiloxane polymer, a boric anhydride, a boride, or any combination thereof.

Some embodiments relate to a method of installation. In some embodiments, the method of installation comprises obtaining at least two roofing membranes. In some embodiments, each of the at least two roofing membranes independently comprises a crosslinked polymer. In some embodiments, each of the at least two roofing membranes independently comprises 1% to 30% by weight of a boron-containing compound based on a total weight of each of the at least two roofing membranes. In some embodiments, the method of installation comprises installing the at least two roofing membranes on a roofing substrate, such that the at least two roofing membranes are partially overlapping in an overlapping portion. In some embodiments, the method of installation comprises adhering the at least two roofing membranes to each other in the overlapping portion.

In some embodiments, the adhering does not comprise heat welding the at least two roofing membranes to each other; wherein the adhering does not comprise adhering the at least two roofing membranes to each other with an adhesive.

BRIEF DESCRIPTION OF THE DRAWINGS

Reference is made to the drawings that form a part of this disclosure, and which illustrate embodiments in which the materials and methods described herein can be practiced.

DETAILED DESCRIPTION

Figure 1:
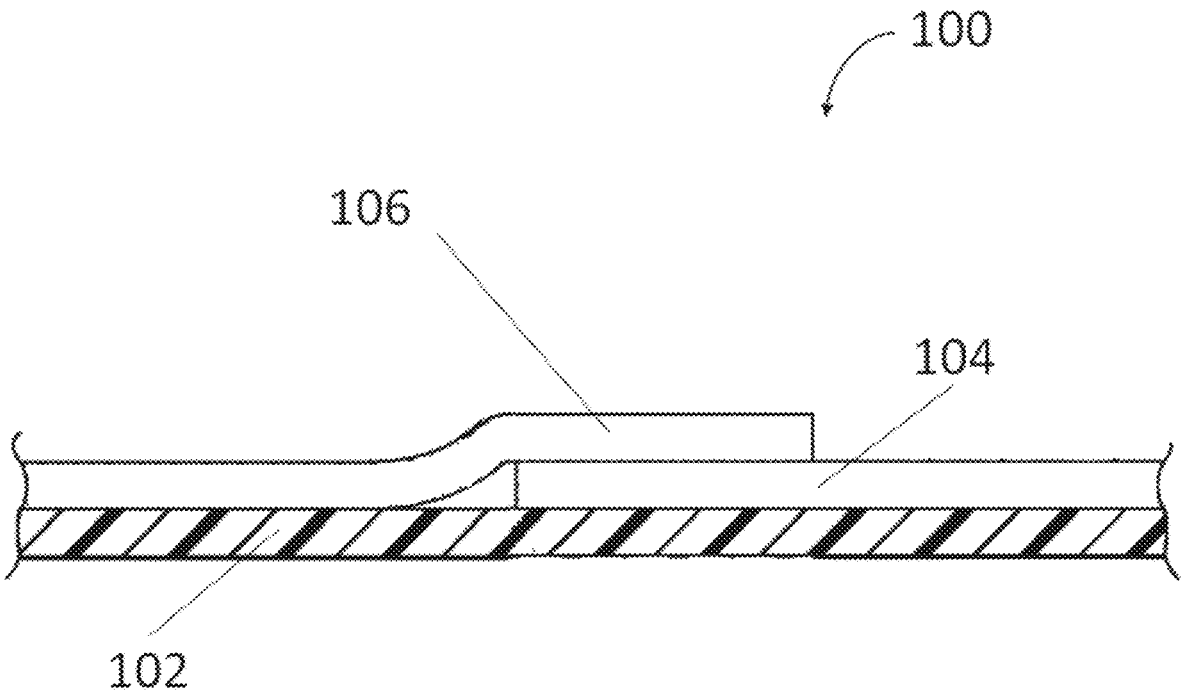
FIG. 1 is a cross-section of a portion of a roofing system, according to some embodiments.

Some embodiments relate to roofing materials and related systems and related methods. In some embodiments, the roofing materials comprise a roofing membrane. In some embodiments, the roofing membranes disclosed herein are configured to be installed on a roofing substrate, so as to form a waterproof roofing system. In some embodiments, a roofing membrane is installed on a roofing substrate in an overlapping relation with another roofing membrane, so as to form a watertight seal between the roofing membrane and the another roofing membrane. In some embodiments, the roofing membranes do not require an adhesive so as to form the watertight seal, without any seam treatment. That is, in some embodiments, the roofing membranes are configured to adhere to each other without the use of an adhesive. In some embodiments, at least one advantage of the roofing membranes is that the self-adhering and self-sealing features of the roofing membranes disclosed herein simplifies the installation process, thereby reducing the time and labor required to install roofing systems, while still achieving a watertight seal between roofing membranes. In some embodiments, a roofing system comprises at least two roofing materials adhered to each other, without use of an adhesive. For example, in some embodiments, the roofing system does not comprise an adhesive located between the at least two roofing materials. In some embodiments, the at least two roofing materials are not heat welded together.

Some embodiments relate to a roofing material. As used herein, the term "roofing material" refers to a roofing membrane, a roofing shingle, a roofing substrate, a roofing accessory, either in liquid form or solid form. For example, in some embodiments, the roofing material comprises a liquid applied membrane. Non-limiting examples of a roofing accessory include, for example and without limitation, at least one of a membrane, a reinforced detailing membrane, an unreinforced detailing membrane, a metal joint detail, a gutter edge detail, a roof edge detail, an end joint detail, a metal drip edge corner, a T-joint patch, a vent boot, a penetration pocket, a universal corner, a cover tape, a pipe boot, a split pipe boot, a square tube wrap, a pourable sealer pocket, a corner reinforcement, a roof penetration, or any combination thereof.

In some embodiments, the roofing material is a roofing membrane. In some embodiments, the roofing membrane is a single layer membrane. In some embodiments, the roofing membrane is a multi-layer membrane. In some embodiments, the roofing membrane is a liquid applied membrane. In some embodiments, the roofing membrane is an extruded roofing membrane. In some embodiments, the roofing membrane is a laminated roofing membrane. In some embodiments, the roofing membrane is a molded roofing membrane. In some embodiments, the roofing membrane is a reinforced roofing membrane. In some embodiments, the roofing membrane is an unreinforced roofing membrane. In some embodiments, the roofing membrane is a coated membrane. In some embodiments, the roofing membrane is a foamed roofing membrane. In some embodiments, the roofing membrane is a closed-cell foamed roofing membrane. In some embodiments, the roofing membrane is provided in the form of a roll of a roofing membrane. In some embodiments, the roofing membrane is provided in the form of a stack of roofing membranes.

In some embodiments, the roofing membrane comprises at least one polymer layer. In some embodiments, the at least one polymer layer is a polymer coating. In some embodiments, the at least one polymer layer is a polymer sheet. In some embodiments, the at least one polymer layer is a polymer film. In some embodiments, the at least one polymer layer comprises one (1) to ten (10) polymer layers. For example, in some the at least one polymer layer comprises at least one of a first polymer layer, a second polymer layer, a third polymer layer, a fourth polymer layer, a fifth polymer layer, a sixth polymer layer, a seventh polymer layer, an eighth polymer layer, a ninth polymer layer, a tenth polymer layer, or any combination thereof. In some embodiments, at least two of the at least one polymer layers are the same. In some embodiments, at least two of the at least one polymer layers are different. In some embodiments, at least one intervening layer is located between at least two of the polymer layers. In some embodiments, at least two of the polymer layers directly contact each other.

In some embodiments, the at least one polymer layer comprises at least one polymer. In some embodiments, the at least one polymer layer comprises a crosslinked polymer.

In some embodiments, the at least one polymer layer comprises 30% to 90% by weight of at least one polymer based on a total weight of the at least one polymer layer. In some embodiments, the at least one polymer layer comprises 35% to 90% by weight of at least one polymer based on a total weight of the at least one polymer layer. In some embodiments, the at least one polymer layer comprises 40% to 90% by weight of at least one polymer based on a total weight of the at least one polymer layer. In some embodiments, the at least one polymer layer comprises 45% to 90% by weight of at least one polymer based on a total weight of the at least one polymer layer. In some embodiments, the at least one polymer layer comprises 50% to 90% by weight of at least one polymer based on a total weight of the at least one polymer layer. In some embodiments, the at least one polymer layer comprises 55% to 90% by weight of at least one polymer based on a total weight of the at least one polymer layer. In some embodiments, the at least one polymer layer comprises 60% to 90% by weight of at least one polymer based on a total weight of the at least one polymer layer. In some embodiments, the at least one polymer layer comprises 65% to 90% by weight of at least one polymer based on a total weight of the at least one polymer layer. In some embodiments, the at least one polymer layer comprises 70% to 90% by weight of at least one polymer based on a total weight of the at least one polymer layer. In some embodiments, the at least one polymer layer comprises 75% to 90% by weight of at least one polymer based on a total weight of the at least one polymer layer. In some embodiments, the at least one polymer layer comprises 80% to 90% by weight of at least one polymer based on a total weight of the at least one polymer layer. In some embodiments, the at least one polymer layer comprises 85% to 90% by weight of at least one polymer based on a total weight of the at least one polymer layer.

In some embodiments, the at least one polymer layer comprises 30% to 85% by weight of at least one polymer based on a total weight of the at least one polymer layer. In some embodiments, the at least one polymer layer comprises 30% to 80% by weight of at least one polymer based on a total weight of the at least one polymer layer. In some embodiments, the at least one polymer layer comprises 30% to 75% by weight of at least one polymer based on a total weight of the at least one polymer layer. In some embodiments, the at least one polymer layer comprises 30% to 70% by weight of at least one polymer based on a total weight of the at least one polymer layer. In some embodiments, the at least one polymer layer comprises 30% to 65% by weight of at least one polymer based on a total weight of the at least one polymer layer. In some embodiments, the at least one polymer layer comprises 30% to 60% by weight of at least one polymer based on a total weight of the at least one polymer layer. In some embodiments, the at least one polymer layer comprises 30% to 55% by weight of at least one polymer based on a total weight of the at least one polymer layer. In some embodiments, the at least one polymer layer comprises 30% to 50% by weight of at least one polymer based on a total weight of the at least one polymer layer. In some embodiments, the at least one polymer layer comprises 30% to 45% by weight of at least one polymer based on a total weight of the at least one polymer layer. In some embodiments, the at least one polymer layer comprises 30% to 40% by weight of at least one polymer based on a total weight of the at least one polymer layer. In some embodiments, the at least one polymer layer comprises 30% to 35% by weight of at least one polymer based on a total weight of the at least one polymer layer.

In some embodiments, the at least one polymer comprises at least one of a polysiloxane, a silyl-terminated polymer, or any combination thereof. In some embodiments, the at least one polymer comprises at least one of a linear polysiloxane, a cyclic polysiloxane, a branched polysiloxane, or any combination thereof. In some embodiments, the at least one polymer comprises at least one of a silyl-terminated polyurethane, a silyl-terminated polyether, a silyl-terminated acrylic, a silyl-terminated polyester, or any combination thereof. In some embodiments, the at least one polymer comprises at least one of polyester, polyethylene, polypropylene, polyurethane, polyurea, or any combination thereof. In some embodiments, the at least one polymer comprises at least one of a liquid silicone resin, a liquid silicone rubber resin (LSR), a heat cured silicone resin, a silicone gum, or any combination thereof. In some embodiments, the at least one polymer comprises at least one of a linear polysiloxane, a cyclic polysiloxane, a branched polysiloxane, polyester, polyethylene, polypropylene, polyurethane, polyurea, a liquid silicone resin, a liquid silicone rubber resin (LSR), a heat cured silicone resin, a silicone gum, a polyolefin, a polycarbonate, a polyether, a silyl-terminated polyurethane, a silyl-terminated polyether, a silyl-terminated acrylic, a silyl-terminated polyester, or any combination thereof.

In some embodiments, the at least one polymer comprises a polysiloxane. As used herein, a "polysiloxane" is a polymer that includes at least two of the following repeat units: $—R_2Si—O—SiR_2—$, where R is an organic group, or hydrogen. As used herein, an "organic group" may encompass any organosilicon group, such as but not limited to a silanol group or an alkyl silyl group. In some embodiments, each R is independently a hydrogen, an alkyl, an alkenyl, or an aryl. In some embodiments, each R is independently a hydrogen, a methyl, a phenyl, or a vinyl. In some embodiments, a terminal group of the polysiloxane is a terminal group of the formula: $—OSiR_3$, wherein each R is independently a hydrogen, an alkyl, an alkenyl, an aryl, or a hydroxyl. For example, in some embodiments, each R of the terminal group is independently a hydrogen, a methyl, a vinyl, or a hydroxyl. In some embodiments, a polysiloxane may include ten or more of the aforementioned repeat units. In some embodiments, a polysiloxane may include hundreds of the aforementioned repeat units. In some embodiments, a polysiloxane may include thousands of the aforementioned repeat units. In some embodiments, a polysiloxane may include tens-of-thousands of the aforementioned repeat units. In some embodiments, a polysiloxane may include hundreds-of-thousands of the aforementioned repeat units. In some embodiments, a polysiloxane may include millions of the aforementioned repeat units. As used herein, a "polysiloxane" may also include any version of the aforementioned formula where at least one of the R groups is substituted with an organic group. In some embodiments, the polysiloxane is unsubstituted, such that all of the R groups may be the same. In some embodiments, the polysiloxane is substituted such that some of the R groups may be the same while others may differ from each other. In some embodiments, the polysiloxane is substituted such that all of the R groups are different. In some embodiments, the polysiloxane is substituted or "terminated" with an organic group at the end of a polymer chain.

In some embodiments, the polysiloxane comprises or is selected from the group consisting of a hydroxy terminated polysiloxane, a di-hydroxy terminated polysiloxane, a vinyl terminated polysiloxane, a di-vinyl terminated polysiloxane, a tri-methyl-silyl terminated polysiloxane, a mono-trimethoxy terminated polysiloxane, a silanol terminated polysiloxane, or any combination thereof.

In some embodiments, the polysiloxane comprises, or is selected from the group consisting of a hydroxy terminated polysiloxane, a di-hydroxy terminated polysiloxane, a vinyl terminated polysiloxane, a di-vinyl terminated polysiloxane, a tri-methyl-silyl terminated polysiloxane, or any combination thereof.

In some embodiments, the polysiloxane comprises or is selected from the group consisting of a mono-trimethoxy terminated polysiloxane, a silanol terminated polysiloxane, or any combination thereof.

In some embodiments, the polysiloxane comprises, consists, or consists essentially of a mono-trimethoxy terminated polysiloxane. In some embodiments, the polysiloxane comprises, consists, or consists essentially of a silanol terminated polysiloxane.

As used herein, a "silane" is any compound having the general formula $Si_nR_{2n+2}$, where R is hydrogen, an organic group, or any combination thereof. As used herein, a "silane" may also include any version of the aforementioned formula where at least one of the R groups is substituted with an organic group. In some embodiments, the silane is unsubstituted, such that all of the R groups may be the same. In some embodiments, the silane is substituted such that some of the R groups may be the same while others may differ from each other. In some embodiments, the silane is substituted such that all of the R groups are different. Examples of at least one substituent R group may include, but is not limited to at least one amino group (in the non-limiting case of an aminosilane) and at least one methoxy group (in the non-limiting case of a methoxysilane).

In some embodiments, a silane may also encompass a bipodal silane. As used herein, a "bipodal silane" is a silane having the general formula $R_3Si—R—SiR_3$.

In some embodiments, the at least one silane comprises or is selected from the group consisting of an associative silane, a non-associative silane, or any combination thereof. In some embodiments, the at least one silane comprises, consists, or consists essentially of an associative silane. In some embodiments, the at least one silane comprises, consists, or consists essentially of a non-associative silane.

As used herein, an "associative silane" is a silane having the general formula $Si(R^1)_n(R^2)_{n+2}$; where each $R^1$ group is a crosslinkable functional group, such as but not limited to, an alkoxy group, acetoxy group, or an oxime group; and where at least one of the $R^2$ groups is a functional group that interacts with another $R^2$ group, interacts with another component in a silicone composition, or any combination thereof. In some embodiments, the interaction occurs by an interaction mechanism, such as but not limited to, hydrogen bonding, electrostatic attraction, TT-TT stacking, or any combination thereof.

As used herein a "non-associative silane" is any silane that is not an "associative silane."

In some embodiments, the associative silane comprises or is selected from the group consisting of an epoxysilane, an aminosilane, a diphenylsilane, or any combination thereof.

In some embodiments, the associative silane comprises or is selected from the group consisting of methacryloxypropyltrimethoxysilane, mercaptopropyltrimethoxysilane methacryloxypropylmethyldimethoxysilane, diphenyldimethoxysilane, an epoxy silane oligomer, glycidoxypropyltrimethoxysilane, aminoethylaminopropyltrimethoxysilane, or any combination thereof.

In some embodiments, the associative silane comprises or is selected from the group consisting of methacryloxypropyltrimethoxysilane, mercaptopropyltrimethoxysilane methacryloxypropylmethyldimethoxysilane, diphenyldimethoxysilane, an epoxy silane oligomer, or any combination thereof.

In some embodiments, the associative silane comprises or is selected from the group consisting of glycidoxypropyltrimethoxysilane, aminoethylaminopropyltrimethoxysilane, or any combination thereof.

In some embodiments, the associative silane comprises, consists, or consists essentially of glycidoxypropyltrimethoxysilane.

In some embodiments, the associative silane comprises, consists, or consists essentially of aminoethylaminopropyltrimethoxysilane.

In some embodiments, the non-associative silane is octylsilane.

In some embodiments, the non-associative silane comprises or is selected from the group consisting of octyltrimethoxysilane, vinyltrimethoxysilane, or any combination thereof.

In some embodiments, the non-associative silane is vinyltrimethoxysilane.

In some embodiments, the non-associative silane is octyltrimethoxysilane.

In some embodiments, the silicone composition comprises at least one bipodal silane. Non-limiting examples of a bipodal silane include bis(trimethoxysilylpropyl)amine (commercially available as Andisil® 1170) and bis [3-(triethoxysilyl) propyl] tetrasulfide (commercially available as Andisil® 1289).

In some embodiments, the silicone composition does not comprise a bipodal silane.

In some embodiments, the silicone composition may exclude certain specific bipodal silanes. For instance, in some embodiments, the silicone composition does not comprise bis-(triethoxysilyl) ethane, bis(trimethoxysilylpropyl) amine, bis [3-(triethoxysilyl) propyl] tetrasulfide, or any combination thereof.

In some embodiments, the polysiloxane comprises a silanol-terminated polysiloxane. In some embodiments, the polysiloxane comprises a silanol-terminated polydimethylsiloxane. In some embodiments, the polysiloxane comprises trimethylsilyl-terminated polydimethylsiloxane polymer.

Examples of hydroxyl-terminated polysiloxanes include, without limitation, Andisil® OH Polymers, such as, for example and without limitation, at least one of Andisil® OH 750 Silanol terminated 750 cps; Andisil® OH 1,000 Silanol terminated 1,000 cps; Andisil® OH 2,000 Silanol terminated 2,000 cps; Andisil® OH 3,500 Silanol terminated 3,500 cps; Andisil® OH 4,000 Silanol terminated 4,000 cps; Andisil® OH 6,000 Silanol terminated 6,000 cps; Andisil® OH 14,000 Silanol terminated 14,000 cps; Andisil® OH 20,000 Silanol terminated 20,000 cps; Andisil® OH 50,000 Silanol terminated 50,000 cps; Andisil® OH 80,000 Silanol terminated 80,000 cps; Andisil® OH 300,000 Silanol terminated 300,000 cps; or any combination thereof.

In some embodiments, the at least one polymer is derived from any one or more of the above polymers.

In some embodiments, the at least one polymer layer comprises a boron-containing compound.

In some embodiments, the at least one polymer layer comprises 1% to 30% by weight of at least one boron-containing compound based on the total weight of the at least one polymer layer.

In some embodiments, the at least one polymer layer comprises 2% to 30% by weight of at least one boron-containing compound based on the total weight of the at least one polymer layer. In some embodiments, the at least one polymer layer comprises 4% to 30% by weight of at least one boron-containing compound based on the total weight of the at least one polymer layer. In some embodiments, the at least one polymer layer comprises 5% to 30% by weight of at least one boron-containing compound based on the total weight of the at least one polymer layer. In some embodiments, the at least one polymer layer comprises 6% to 30% by weight of at least one boron-containing compound based on the total weight of the at least one polymer layer. In some embodiments, the at least one polymer layer comprises 8% to 30% by weight of at least one boron-containing compound based on the total weight of the at least one polymer layer. In some embodiments, the at least one polymer layer comprises 10% to 30% by weight of at least one boron-containing compound based on the total weight of the at least one polymer layer. In some embodiments, the at least one polymer layer comprises 12% to 30% by weight of at least one boron-containing compound based on the total weight of the at least one polymer layer. In some embodiments, the at least one polymer layer comprises 14% to 30% by weight of at least one boron-containing compound based on the total weight of the at least one polymer layer. In some embodiments, the at least one polymer layer comprises 15% to 30% by weight of at least one boron-containing compound based on the total weight of the at least one polymer layer. In some embodiments, the at least one polymer layer comprises 16% to 30% by weight of at least one boron-containing compound based on the total weight of the at least one polymer layer. In some embodiments, the at least one polymer layer comprises 18% to 30% by weight of at least one boron-containing compound based on the total weight of the at least one polymer layer. In some embodiments, the at least one polymer layer comprises 20% to 30% by weight of at least one boron-containing compound based on the total weight of the at least one polymer layer. In some embodiments, the at least one polymer layer comprises 22% to 30% by weight of at least one boron-containing compound based on the total weight of the at least one polymer layer. In some embodiments, the at least one polymer layer comprises 24% to 30% by weight of at least one boron-containing compound based on the total weight of the at least one polymer layer. In some embodiments, the at least one polymer layer comprises 25% to 30% by weight of at least one boron-containing compound based on the total weight of the at least one polymer layer. In some embodiments, the at least one polymer layer comprises 26% to 30% by weight of at least one boron-containing compound based on the total weight of the at least one polymer layer. In some embodiments, the at least one polymer layer comprises 28% to 30% by weight of at least one boron-containing compound based on the total weight of the at least one polymer layer.

In some embodiments, the at least one polymer layer comprises 1% to 28% by weight of at least one boron-containing compound based on the total weight of the at least one polymer layer. In some embodiments, the at least one polymer layer comprises 1% to 26% by weight of at least one boron-containing compound based on the total weight of the at least one polymer layer. In some embodiments, the at least one polymer layer comprises 1% to 25% by weight of at least one boron-containing compound based on the total weight of the at least one polymer layer. In some embodiments, the at least one polymer layer comprises 1% to 24% by weight of at least one boron-containing compound based on the total weight of the at least one polymer layer. In some embodiments, the at least one polymer layer comprises 1% to 22% by weight of at least one boron-containing compound based on the total weight of the at least one polymer layer. In some embodiments, the at least one polymer layer comprises 1% to 20% by weight of at least one boron-containing compound based on the total weight of the at least one polymer layer. In some embodiments, the at least one polymer layer comprises 1% to 18% by weight of at least one boron-containing compound based on the total weight of the at least one polymer layer. In some embodiments, the at least one polymer layer comprises 1% to 16% by weight of at least one boron-containing compound based on the total weight of the at least one polymer layer. In some embodiments, the at least one polymer layer comprises 1% to 15% by weight of at least one boron-containing compound based on the total weight of the at least one polymer layer. In some embodiments, the at least one polymer layer comprises 1% to 14% by weight of at least one boron-containing compound based on the total weight of the at least one polymer layer. In some embodiments, the at least one polymer layer comprises 1% to 12% by weight of at least one boron-containing compound based on the total weight of the at least one polymer layer. In some embodiments, the at least one polymer layer comprises 1% to 10% by weight of at least one boron-containing compound based on the total weight of the at least one polymer layer. In some embodiments, the at least one polymer layer comprises 1% to 8% by weight of at least one boron-containing compound based on the total weight of the at least one polymer layer. In some embodiments, the at least one polymer layer comprises 1% to 6% by weight of at least one boron-containing compound based on the total weight of the at least one polymer layer. In some embodiments, the at least one polymer layer comprises 1% to 5% by weight of at least one boron-containing compound based on the total weight of the at least one polymer layer. In some embodiments, the at least one polymer layer comprises 1% to 4% by weight of at least one boron-containing compound based on the total weight of the at least one polymer layer. In some embodiments, the at least one polymer layer comprises 1% to 2% by weight of at least one boron-containing compound based on the total weight of the at least one polymer layer.

In some embodiments, the boron-containing compound comprises at least one of a boric acid, a boronic acid, a pyroboric acid, a boronate ester, a borate ester, a borosiloxane oligomer, a borosiloxane polymer, a boric anhydride, a boride, or any combination thereof. In some embodiments, the boron-containing compound does not comprise at least one of a boric acid, a boronic acid, a pyroboric acid, a boronate ester, a borate ester, a borosiloxane oligomer, a borosiloxane polymer, a boric anhydride, a boride, or any combination thereof. In some embodiments, the boron-containing compound does not comprise at least one or more of the aforementioned boron-containing compounds.

In some embodiments, the at least one polymer compound comprises a silicone fluid.

In some embodiments, the at least one polymer layer comprises 1% to 30% by weight of the silicone fluid based on the total weight of the at least one polymer layer. In some embodiments, the at least one polymer layer comprises 2% to 30% by weight of the silicone fluid based on the total weight of the at least one polymer layer. In some embodiments, the at least one polymer layer comprises 4% to 30% by weight of the silicone fluid based on the total weight of the at least one polymer layer. In some embodiments, the at least one polymer layer comprises 5% to 30% by weight of the silicone fluid based on the total weight of the at least one polymer layer. In some embodiments, the at least one polymer layer comprises 6% to 30% by weight of the silicone fluid based on the total weight of the at least one polymer layer. In some embodiments, the at least one polymer layer comprises 8% to 30% by weight of the silicone fluid based on the total weight of the at least one polymer layer. In some embodiments, the at least one polymer layer comprises 10% to 30% by weight of the silicone fluid based on the total weight of the at least one polymer layer. In some embodiments, the at least one polymer layer comprises 12% to 30% by weight of the silicone fluid based on the total weight of the at least one polymer layer. In some embodiments, the at least one polymer layer comprises 14% to 30% by weight of the silicone fluid based on the total weight of the at least one polymer layer. In some embodiments, the at least one polymer layer comprises 15% to 30% by weight of the silicone fluid based on the total weight of the at least one polymer layer. In some embodiments, the at least one polymer layer comprises 16% to 30% by weight of the silicone fluid based on the total weight of the at least one polymer layer. In some embodiments, the at least one polymer layer comprises 18% to 30% by weight of the silicone fluid based on the total weight of the at least one polymer layer. In some embodiments, the at least one polymer layer comprises 20% to 30% by weight of the silicone fluid based on the total weight of the at least one polymer layer. In some embodiments, the at least one polymer layer comprises 22% to 30% by weight of the silicone fluid based on the total weight of the at least one polymer layer. In some embodiments, the at least one polymer layer comprises 24% to 30% by weight of the silicone fluid based on the total weight of the at least one polymer layer. In some embodiments, the at least one polymer layer comprises 25% to 30% by weight of the silicone fluid based on the total weight of the at least one polymer layer. In some embodiments, the at least one polymer layer comprises 26% to 30% by weight of the silicone fluid based on the total weight of the at least one polymer layer. In some embodiments, the at least one polymer layer comprises 28% to 30% by weight of the silicone fluid based on the total weight of the at least one polymer layer.

In some embodiments, the at least one polymer layer comprises 1% to 28% by weight of the silicone fluid based on the total weight of the at least one polymer layer. In some embodiments, the at least one polymer layer comprises 1% to 26% by weight of the silicone fluid based on the total weight of the at least one polymer layer. In some embodiments, the at least one polymer layer comprises 1% to 25% by weight of the silicone fluid based on the total weight of the at least one polymer layer. In some embodiments, the at least one polymer layer comprises 1% to 24% by weight of the silicone fluid based on the total weight of the at least one polymer layer. In some embodiments, the at least one polymer layer comprises 1% to 22% by weight of the silicone fluid based on the total weight of the at least one polymer layer. In some embodiments, the at least one polymer layer comprises 1% to 20% by weight of the silicone fluid based on the total weight of the at least one polymer layer. In some embodiments, the at least one polymer layer comprises 1% to 18% by weight of the silicone fluid based on the total weight of the at least one polymer layer. In some embodiments, the at least one polymer layer comprises 1% to 16% by weight of the silicone fluid based on the total weight of the at least one polymer layer. In some embodiments, the at least one polymer layer comprises 1% to 15% by weight of the silicone fluid based on the total weight of the at least one polymer layer. In some embodiments, the at least one polymer layer comprises 1% to 14% by weight of the silicone fluid based on the total weight of the at least one polymer layer. In some embodiments, the at least one polymer layer comprises 1% to 12% by weight of the silicone fluid based on the total weight of the at least one polymer layer. In some embodiments, the at least one polymer layer comprises 1% to 10% by weight of the silicone fluid based on the total weight of the at least one polymer layer. In some embodiments, the at least one polymer layer comprises 1% to 8% by weight of the silicone fluid based on the total weight of the at least one polymer layer. In some embodiments, the at least one polymer layer comprises 1% to 6% by weight of the silicone fluid based on the total weight of the at least one polymer layer. In some embodiments, the at least one polymer layer comprises 1% to 5% by weight of the silicone fluid based on the total weight of the at least one polymer layer. In some embodiments, the at least one polymer layer comprises 1% to 4% by weight of the silicone fluid based on the total weight of the at least one polymer layer. In some embodiments, the at least one polymer layer comprises 1% to 2% by weight of the silicone fluid based on the total weight of the at least one polymer layer.

In some embodiments, the silicone fluid comprises an inert silicone fluid. In some embodiments, the silicone fluid comprises at least one of a linear silicone, a cyclic silicone, a branched silicone, or any combination thereof. In some embodiments, the silicone fluid comprises at least one of octamethylcyclotetrasiloxane, decamethylcyclopentasiloxane, trimethylsilyl terminated linear polydimethylsiloxane, or any combination thereof.

In some embodiments, the at least one polymer compound comprises at least one filler.

In some embodiments, the at least one polymer layer comprises 1% to 70% by weight of the at least one filler based on the total weight of the at least one polymer layer.

In some embodiments, the at least one polymer layer comprises 5% to 70% by weight of the at least one filler based on the total weight of the at least one polymer layer. In some embodiments, the at least one polymer layer comprises 10% to 70% by weight of the at least one filler based on the total weight of the at least one polymer layer. In some embodiments, the at least one polymer layer comprises 15% to 70% by weight of the at least one filler based on the total weight of the at least one polymer layer. In some embodiments, the at least one polymer layer comprises 20% to 70% by weight of the at least one filler based on the total weight of the at least one polymer layer. In some embodiments, the at least one polymer layer comprises 25% to 70% by weight of the at least one filler based on the total weight of the at least one polymer layer. In some embodiments, the at least one polymer layer comprises 30% to 70% by weight of the at least one filler based on the total weight of the at least one polymer layer. In some embodiments, the at least one polymer layer comprises 35% to 70% by weight of the at least one filler based on the total weight of the at least one polymer layer. In some embodiments, the at least one polymer layer comprises 40% to 70% by weight of the at least one filler based on the total weight of the at least one polymer layer. In some embodiments, the at least one polymer layer comprises 45% to 70% by weight of the at least one filler based on the total weight of the at least one polymer layer. In some embodiments, the at least one polymer layer comprises 50% to 70% by weight of the at least one filler based on the total weight of the at least one polymer layer. In some embodiments, the at least one polymer layer comprises 55% to 70% by weight of the at least one filler based on the total weight of the at least one polymer layer. In some embodiments, the at least one polymer layer comprises 60% to 70% by weight of the at least one filler based on the total weight of the at least one polymer layer. In some embodiments, the at least one polymer layer comprises 65% to 70% by weight of the at least one filler based on the total weight of the at least one polymer layer.

In some embodiments, the at least one polymer layer comprises 1% to 65% by weight of the at least one filler based on the total weight of the at least one polymer layer. In some embodiments, the at least one polymer layer comprises 1% to 60% by weight of the at least one filler based on the total weight of the at least one polymer layer. In some embodiments, the at least one polymer layer comprises 1% to 55% by weight of the at least one filler based on the total weight of the at least one polymer layer. In some embodiments, the at least one polymer layer comprises 1% to 50% by weight of the at least one filler based on the total weight of the at least one polymer layer. In some embodiments, the at least one polymer layer comprises 1% to 45% by weight of the at least one filler based on the total weight of the at least one polymer layer. In some embodiments, the at least one polymer layer comprises 1% to 40% by weight of the at least one filler based on the total weight of the at least one polymer layer. In some embodiments, the at least one polymer layer comprises 1% to 35% by weight of the at least one filler based on the total weight of the at least one polymer layer. In some embodiments, the at least one polymer layer comprises 1% to 30% by weight of the at least one filler based on the total weight of the at least one polymer layer. In some embodiments, the at least one polymer layer comprises 1% to 25% by weight of the at least one filler based on the total weight of the at least one polymer layer. In some embodiments, the at least one polymer layer comprises 1% to 20% by weight of the at least one filler based on the total weight of the at least one polymer layer. In some embodiments, the at least one polymer layer comprises 1% to 15% by weight of the at least one filler based on the total weight of the at least one polymer layer. In some embodiments, the at least one polymer layer comprises 1% to 10% by weight of the at least one filler based on the total weight of the at least one polymer layer. In some embodiments, the at least one polymer layer comprises 1% to 5% by weight of the at least one filler based on the total weight of the at least one polymer layer.

In some embodiments, the at least one filler comprises at least one of nepheline syenite, calcium carbonate, barium sulfate, iron oxide, diatomaceous earth, melamine, quartz, silica, colloidal silica, crystalline silica, precipitated silica, amorphous silica, titanium dioxide, alumina trihydrate, zinc oxide, zirconium oxide, zirconium silicate, zinc borate, chromic oxide, crystalline silica fine powder, amorphous silica fine powder, silicone rubber powder, glass, glass bubbles, glass powder, zeolites, silica hydrogen, silica aero gel, calcium silicate, aluminum silicate, aluminum oxide, ferrite, carbon black, graphite, mica, clay, bentonite, ground quartz, kaolin, calcined kaolin, wollastonite, hydroxyapatite, hydrated alumina, magnesium hydroxide, vermiculite, talcum, slaked lime, or any combination thereof.

In some embodiments, the at least one polymer compound comprises a fumed silica.

In some embodiments, the at least one polymer layer comprises 0.1% to 20% by weight of the fumed silica based on the total weight of the at least one polymer layer.

In some embodiments, the at least one polymer layer comprises 0.5% to 20% by weight of the fumed silica based on the total weight of the at least one polymer layer. In some embodiments, the at least one polymer layer comprises 1% to 20% by weight of the fumed silica based on the total weight of the at least one polymer layer. In some embodiments, the at least one polymer layer comprises 2% to 20% by weight of the fumed silica based on the total weight of the at least one polymer layer. In some embodiments, the at least one polymer layer comprises 4% to 20% by weight of the fumed silica based on the total weight of the at least one polymer layer. In some embodiments, the at least one polymer layer comprises 5% to 20% by weight of the fumed silica based on the total weight of the at least one polymer layer. In some embodiments, the at least one polymer layer comprises 6% to 20% by weight of the fumed silica based on the total weight of the at least one polymer layer. In some embodiments, the at least one polymer layer comprises 8% to 20% by weight of the fumed silica based on the total weight of the at least one polymer layer. In some embodiments, the at least one polymer layer comprises 10% to 20% by weight of the fumed silica based on the total weight of the at least one polymer layer. In some embodiments, the at least one polymer layer comprises 12% to 20% by weight of the fumed silica based on the total weight of the at least one polymer layer. In some embodiments, the at least one polymer layer comprises 14% to 20% by weight of the fumed silica based on the total weight of the at least one polymer layer. In some embodiments, the at least one polymer layer comprises 15% to 20% by weight of the fumed silica based on the total weight of the at least one polymer layer. In some embodiments, the at least one polymer layer comprises 16% to 20% by weight of the fumed silica based on the total weight of the at least one polymer layer. In some embodiments, the at least one polymer layer comprises 18% to 20% by weight of the fumed silica based on the total weight of the at least one polymer layer.

In some embodiments, the at least one polymer layer comprises 0.1% to 18% by weight of the fumed silica based on the total weight of the at least one polymer layer. In some embodiments, the at least one polymer layer comprises 0.1% to 16% by weight of the fumed silica based on the total weight of the at least one polymer layer. In some embodiments, the at least one polymer layer comprises 0.1% to 15% by weight of the fumed silica based on the total weight of the at least one polymer layer. In some embodiments, the at least one polymer layer comprises 0.1% to 14% by weight of the fumed silica based on the total weight of the at least one polymer layer. In some embodiments, the at least one polymer layer comprises 0.1% to 12% by weight of the fumed silica based on the total weight of the at least one polymer layer. In some embodiments, the at least one polymer layer comprises 0.1% to 10% by weight of the fumed silica based on the total weight of the at least one polymer layer. In some embodiments, the at least one polymer layer comprises 0.1% to 8% by weight of the fumed silica based on the total weight of the at least one polymer layer. In some embodiments, the at least one polymer layer comprises 0.1% to 6% by weight of the fumed silica based on the total weight of the at least one polymer layer. In some embodiments, the at least one polymer layer comprises 0.1% to 5% by weight of the fumed silica based on the total weight of the at least one polymer layer. In some embodiments, the at least one polymer layer comprises 0.1% to 4% by weight of the fumed silica based on the total weight of the at least one polymer layer. In some embodiments, the at least one polymer layer comprises 0.1% to 2% by weight of the fumed silica based on the total weight of the at least one polymer layer. In some embodiments, the at least one polymer layer comprises 0.1% to 1% by weight of the fumed silica based on the total weight of the at least one polymer layer. In some embodiments, the at least one polymer layer comprises 0.1% to 0.8% by weight of the fumed silica based on the total weight of the at least one polymer layer. In some embodiments, the at least one polymer layer comprises 0.1% to 0.6% by weight of the fumed silica based on the total weight of the at least one polymer layer. In some embodiments, the at least one polymer layer comprises 0.1% to 0.5% by weight of the fumed silica based on the total weight of the at least one polymer layer. In some embodiments, the at least one polymer layer comprises 0.1% to 0.4% by weight of the fumed silica based on the total weight of the at least one polymer layer. In some embodiments, the at least one polymer layer comprises 0.1% to 0.2% by weight of the fumed silica based on the total weight of the at least one polymer layer.

In some embodiments, the fumed silica comprises at least one of a fumed silica powder, a modified fumed silica, a hydrophilic fumed silica, a hydrophobic fumed silica, or any combination thereof. In some embodiments, the fumed silica is after treated with dimethyldichlorosilane.

In some embodiments, the at least one polymer compound comprises at least one pigment.

In some embodiments, the at least one polymer layer comprises 1% to 20% by weight of the at least one pigment based on the total weight of the at least one polymer layer. In some embodiments, the at least one polymer layer comprises 2% to 20% by weight of the at least one pigment based on the total weight of the at least one polymer layer. In some embodiments, the at least one polymer layer comprises 4% to 20% by weight of the at least one pigment based on the total weight of the at least one polymer layer. In some embodiments, the at least one polymer layer comprises 5% to 20% by weight of the at least one pigment based on the total weight of the at least one polymer layer. In some embodiments, the at least one polymer layer comprises 6% to 20% by weight of the at least one pigment based on the total weight of the at least one polymer layer. In some embodiments, the at least one polymer layer comprises 8% to 20% by weight of the at least one pigment based on the total weight of the at least one polymer layer. In some embodiments, the at least one polymer layer comprises 10% to 20% by weight of the at least one pigment based on the total weight of the at least one polymer layer. In some embodiments, the at least one polymer layer comprises 12% to 20% by weight of the at least one pigment based on the total weight of the at least one polymer layer. In some embodiments, the at least one polymer layer comprises 14% to 20% by weight of the at least one pigment based on the total weight of the at least one polymer layer. In some embodiments, the at least one polymer layer comprises 15% to 20% by weight of the at least one pigment based on the total weight of the at least one polymer layer. In some embodiments, the at least one polymer layer comprises 16% to 20% by weight of the at least one pigment based on the total weight of the at least one polymer layer. In some embodiments, the at least one polymer layer comprises 18% to 20% by weight of the at least one pigment based on the total weight of the at least one polymer layer.

In some embodiments, the at least one polymer layer comprises 1% to 18% by weight of the at least one pigment based on the total weight of the at least one polymer layer. In some embodiments, the at least one polymer layer comprises 1% to 16% by weight of the at least one pigment based on the total weight of the at least one polymer layer. In some embodiments, the at least one polymer layer comprises 1% to 15% by weight of the at least one pigment based on the total weight of the at least one polymer layer. In some embodiments, the at least one polymer layer comprises 1% to 14% by weight of the at least one pigment based on the total weight of the at least one polymer layer. In some embodiments, the at least one polymer layer comprises 1% to 12% by weight of the at least one pigment based on the total weight of the at least one polymer layer. In some embodiments, the at least one polymer layer comprises 1% to 10% by weight of the at least one pigment based on the total weight of the at least one polymer layer. In some embodiments, the at least one polymer layer comprises 1% to 8% by weight of the at least one pigment based on the total weight of the at least one polymer layer. In some embodiments, the at least one polymer layer comprises 1% to 6% by weight of the at least one pigment based on the total weight of the at least one polymer layer. In some embodiments, the at least one polymer layer comprises 1% to 5% by weight of the at least one pigment based on the total weight of the at least one polymer layer. In some embodiments, the at least one polymer layer comprises 1% to 4% by weight of the at least one pigment based on the total weight of the at least one polymer layer. In some embodiments, the at least one polymer layer comprises 1% to 2% by weight of the at least one pigment based on the total weight of the at least one polymer layer.

In some embodiments, the at least one pigment comprises at least one of zinc oxide, antimony oxide, zirconium oxide, chromium oxide, iron oxide, lead oxide, zinc sulfide, titanium dioxide (anatase, rutile, or brookite), lithopone, and carbon black, or any combination thereof.

In some embodiments, the at least one polymer compound comprises at least one crosslinker.

In some embodiments, the at least one polymer layer comprises 1% to 25% by weight of the at least one crosslinker based on the total weight of the at least one polymer layer. In some embodiments, the at least one polymer layer comprises 2% to 25% by weight of the at least one crosslinker based on the total weight of the at least one polymer layer. In some embodiments, the at least one polymer layer comprises 4% to 25% by weight of the at least one crosslinker based on the total weight of the at least one polymer layer. In some embodiments, the at least one polymer layer comprises 5% to 25% by weight of the at least one crosslinker based on the total weight of the at least one polymer layer. In some embodiments, the at least one polymer layer comprises 6% to 25% by weight of the at least one crosslinker based on the total weight of the at least one polymer layer. In some embodiments, the at least one polymer layer comprises 8% to 25% by weight of the at least one crosslinker based on the total weight of the at least one polymer layer. In some embodiments, the at least one polymer layer comprises 10% to 25% by weight of the at least one crosslinker based on the total weight of the at least one polymer layer. In some embodiments, the at least one polymer layer comprises 12% to 25% by weight of the at least one crosslinker based on the total weight of the at least one polymer layer. In some embodiments, the at least one polymer layer comprises 14% to 25% by weight of the at least one crosslinker based on the total weight of the at least one polymer layer. In some embodiments, the at least one polymer layer comprises 15% to 25% by weight of the at least one crosslinker based on the total weight of the at least one polymer layer. In some embodiments, the at least one polymer layer comprises 16% to 25% by weight of the at least one crosslinker based on the total weight of the at least one polymer layer. In some embodiments, the at least one polymer layer comprises 18% to 25% by weight of the at least one crosslinker based on the total weight of the at least one polymer layer. In some embodiments, the at least one polymer layer comprises 20% to 25% by weight of the at least one crosslinker based on the total weight of the at least one polymer layer. In some embodiments, the at least one polymer layer comprises 22% to 25% by weight of the at least one crosslinker based on the total weight of the at least one polymer layer. In some embodiments, the at least one polymer layer comprises 24% to 25% by weight of the at least one crosslinker based on the total weight of the at least one polymer layer.

In some embodiments, the at least one polymer layer comprises 1% to 24% by weight of the at least one crosslinker based on the total weight of the at least one polymer layer. In some embodiments, the at least one polymer layer comprises 1% to 22% by weight of the at least one crosslinker based on the total weight of the at least one polymer layer. In some embodiments, the at least one polymer layer comprises 1% to 20% by weight of the at least one crosslinker based on the total weight of the at least one polymer layer. In some embodiments, the at least one polymer layer comprises 1% to 18% by weight of the at least one crosslinker based on the total weight of the at least one polymer layer. In some embodiments, the at least one polymer layer comprises 1% to 16% by weight of the at least one crosslinker based on the total weight of the at least one polymer layer. In some embodiments, the at least one polymer layer comprises 1% to 15% by weight of the at least one crosslinker based on the total weight of the at least one polymer layer. In some embodiments, the at least one polymer layer comprises 1% to 14% by weight of the at least one crosslinker based on the total weight of the at least one polymer layer. In some embodiments, the at least one polymer layer comprises 1% to 12% by weight of the at least one crosslinker based on the total weight of the at least one polymer layer. In some embodiments, the at least one polymer layer comprises 1% to 10% by weight of the at least one crosslinker based on the total weight of the at least one polymer layer. In some embodiments, the at least one polymer layer comprises 1% to 8% by weight of the at least one crosslinker based on the total weight of the at least one polymer layer. In some embodiments, the at least one polymer layer comprises 1% to 6% by weight of the at least one crosslinker based on the total weight of the at least one polymer layer. In some embodiments, the at least one polymer layer comprises 1% to 5% by weight of the at least one crosslinker based on the total weight of the at least one polymer layer. In some embodiments, the at least one polymer layer comprises 1% to 4% by weight of the at least one crosslinker based on the total weight of the at least one polymer layer. In some embodiments, the at least one polymer layer comprises 1% to 2% by weight of the at least one crosslinker based on the total weight of the at least one polymer layer.

In some embodiments, the at least one crosslinker comprises a neutral curing agent. In some embodiments, the at least one crosslinker comprises at least one of ketoxime silanes, alkoxysilanes, acetoxysilanes, isopropenoxy silanes, a partial hydrolysate/condensate of said silanes, or any combination thereof. In some embodiments, the at least one crosslinker comprises an organosilane, which may contain at least 2 or at least 3 hydrolyzable groups in one molecule and/or its partial hydrolysate. In some embodiments, a hydrolyzable group in such an organosilane or its partial hydrolysate includes at least one of a ketoxime group, an alkoxy group, an acetoxy group, an isopropenoxy group, or any combination thereof. In some embodiments, the at least one crosslinker comprises an organic titanate, a thermal radical initiator, a UV radical initiator, or any combination thereof. In some embodiments, the at least one crosslinker comprises ketoxime silanes. In some embodiments, a ketoxime silane comprises at least one of tetrakis(methylethylketoxime) silane, methyltris(dimethylketoxime) silane, methyltris(methylethylketoxime) silane, ethyltris (methylethylketoxime) silane, methyltris(methyl isobutyl ketoxime) silane, vinyl tris(methylethylketoxime) silane or any combination thereof. In some embodiments, the at least one crosslinker comprises an alkoxysilane. In some embodiments, the alkoxysilane comprises at least one of methyltrimethoxysilane, vinyltrimethoxysilane, phenyltrimethoxysilane, vinyltriethoxy silane, or any combination thereof. In some embodiments, the at least one crosslinker comprises an acetoxysilane. In some embodiments, the acetoxysilane comprises at least one of methyltriacetoxysilane, vinyltriacetoxysilane, or any combination thereof. In some embodiments, the at least one crosslinker comprises an isopropenoxy silane. In some embodiments, the isopropenoxy silane comprises at least one of methyltriisopropenoxysilane, vinyltriisopropenoxysilane, phenyltriisopropenoxysilane, or any combination thereof. In some embodiments, the at least one crosslinker comprises a partial hydrolysate/condensate of any one of the silanes disclosed herein. In some embodiments, the at least one crosslinker comprises at least one of methyltris(methylethylketoxime) silane, vinyltris(methylethylketoxime) silane, or any combination thereof.

In some embodiments, the at least one polymer compound comprises at least one catalyst.

In some embodiments, the at least one polymer layer comprises 0.1% to 15% by weight of the at least one catalyst based on the total weight of the at least one polymer layer. In some embodiments, the at least one polymer layer comprises 0.5% to 15% by weight of the at least one catalyst based on the total weight of the at least one polymer layer. In some embodiments, the at least one polymer layer comprises 1% to 15% by weight of the at least one catalyst based on the total weight of the at least one polymer layer. In some embodiments, the at least one polymer layer comprises 2% to 15% by weight of the at least one catalyst based on the total weight of the at least one polymer layer. In some embodiments, the at least one polymer layer comprises 4% to 15% by weight of the at least one catalyst based on the total weight of the at least one polymer layer. In some embodiments, the at least one polymer layer comprises 5% to 15% by weight of the at least one catalyst based on the total weight of the at least one polymer layer. In some embodiments, the at least one polymer layer comprises 6% to 15% by weight of the at least one catalyst based on the total weight of the at least one polymer layer. In some embodiments, the at least one polymer layer comprises 8% to 15% by weight of the at least one catalyst based on the total weight of the at least one polymer layer. In some embodiments, the at least one polymer layer comprises 10% to 15% by weight of the at least one catalyst based on the total weight of the at least one polymer layer. In some embodiments, the at least one polymer layer comprises 12% to 15% by weight of the at least one catalyst based on the total weight of the at least one polymer layer. In some embodiments, the at least one polymer layer comprises 14% to 15% by weight of the at least one catalyst based on the total weight of the at least one polymer layer.

In some embodiments, the at least one polymer layer comprises 0.1% to 14% by weight of the at least one catalyst based on the total weight of the at least one polymer layer. In some embodiments, the at least one polymer layer comprises 0.1% to 12% by weight of the at least one catalyst based on the total weight of the at least one polymer layer. In some embodiments, the at least one polymer layer comprises 0.1% to 10% by weight of the at least one catalyst based on the total weight of the at least one polymer layer. In some embodiments, the at least one polymer layer comprises 0.1% to 8% by weight of the at least one catalyst based on the total weight of the at least one polymer layer. In some embodiments, the at least one polymer layer comprises 0.1% to 6% by weight of the at least one catalyst based on the total weight of the at least one polymer layer. In some embodiments, the at least one polymer layer comprises 0.1% to 5% by weight of the at least one catalyst based on the total weight of the at least one polymer layer. In some embodiments, the at least one polymer layer comprises 0.1% to 4% by weight of the at least one catalyst based on the total weight of the at least one polymer layer. In some embodiments, the at least one polymer layer comprises 0.1% to 2% by weight of the at least one catalyst based on the total weight of the at least one polymer layer. In some embodiments, the at least one polymer layer comprises 0.1% to 1% by weight of the at least one catalyst based on the total weight of the at least one polymer layer. In some embodiments, the at least one polymer layer comprises 0.1% to 0.8% by weight of the at least one catalyst based on the total weight of the at least one polymer layer. In some embodiments, the at least one polymer layer comprises 0.1% to 0.6% by weight of the at least one catalyst based on the total weight of the at least one polymer layer. In some embodiments, the at least one polymer layer comprises 0.1% to 0.5% by weight of the at least one catalyst based on the total weight of the at least one polymer layer. In some embodiments, the at least one polymer layer comprises 0.1% to 0.4% by weight of the at least one catalyst based on the total weight of the at least one polymer layer. In some embodiments, the at least one polymer layer comprises 0.1% to 0.2% by weight of the at least one catalyst based on the total weight of the at least one polymer layer.

In some embodiments, the at least one catalyst comprises at least one of an organic tin, an organic platinum, triethanolamine titanate, dimethyltin dioleate, dibutyltin diacetate, stannous octoate, dibutyltin dioctoate, dibutyltin dilaurate, dibutyltin dimethoxide, dibutyltin bis(acetylacetonate), dibutyltin bis(benzylmalate), dimethyltin dimethoxide, dimethyltin diacetate, dioctyltin dioctate, dioctyltin dilaurate, tin dioctate, tin laurate, tetraisopropyl titanate, tetra-n-butyl titanate, tetra-tertiary butyl titanate, tetra-n-propyl titanate, tetra-2-ethylhexyl titanate, diisopropyl di-tertiary butyl titanate, dimethoxy titanium bisacetylacetonate, diisopropoxy titanium bisethyl acetoacetate, di-tertiary butoxy titanium bisethyl acetoacetate, di-tertiary butoxy titanium bismethyl acetoacetate, or any combination thereof.

In some embodiments, the at least one polymer compound comprises at least one adhesion promoter.

In some embodiments, the at least one polymer layer comprises 0.1% to 20% by weight of the at least one adhesion promoter based on the total weight of the at least one polymer layer. In some embodiments, the at least one polymer layer comprises 0.5% to 20% by weight of the at least one adhesion promoter based on the total weight of the at least one polymer layer. In some embodiments, the at least one polymer layer comprises 1% to 20% by weight of the at least one adhesion promoter based on the total weight of the at least one polymer layer. In some embodiments, the at least one polymer layer comprises 2% to 20% by weight of the at least one adhesion promoter based on the total weight of the at least one polymer layer. In some embodiments, the at least one polymer layer comprises 4% to 20% by weight of the at least one adhesion promoter based on the total weight of the at least one polymer layer. In some embodiments, the at least one polymer layer comprises 5% to 20% by weight of the at least one adhesion promoter based on the total weight of the at least one polymer layer. In some embodiments, the at least one polymer layer comprises 6% to 20% by weight of the at least one adhesion promoter based on the total weight of the at least one polymer layer. In some embodiments, the at least one polymer layer comprises 8% to 20% by weight of the at least one adhesion promoter based on the total weight of the at least one polymer layer. In some embodiments, the at least one polymer layer comprises 10% to 20% by weight of the at least one adhesion promoter based on the total weight of the at least one polymer layer. In some embodiments, the at least one polymer layer comprises 12% to 20% by weight of the at least one adhesion promoter based on the total weight of the at least one polymer layer. In some embodiments, the at least one polymer layer comprises 14% to 20% by weight of the at least one adhesion promoter based on the total weight of the at least one polymer layer. In some embodiments, the at least one polymer layer comprises 15% to 20% by weight of the at least one adhesion promoter based on the total weight of the at least one polymer layer. In some embodiments, the at least one polymer layer comprises 16% to 20% by weight of the at least one adhesion promoter based on the total weight of the at least one polymer layer. In some embodiments, the at least one polymer layer comprises 18% to 20% by weight of the at least one adhesion promoter based on the total weight of the at least one polymer layer.

In some embodiments, the at least one polymer layer comprises 0.1% to 18% by weight of the at least one adhesion promoter based on the total weight of the at least one polymer layer. In some embodiments, the at least one polymer layer comprises 0.1% to 16% by weight of the at least one adhesion promoter based on the total weight of the at least one polymer layer. In some embodiments, the at least one polymer layer comprises 0.1% to 15% by weight of the at least one adhesion promoter based on the total weight of the at least one polymer layer. In some embodiments, the at least one polymer layer comprises 0.1% to 14% by weight of the at least one adhesion promoter based on the total weight of the at least one polymer layer. In some embodiments, the at least one polymer layer comprises 0.1% to 12% by weight of the at least one adhesion promoter based on the total weight of the at least one polymer layer. In some embodiments, the at least one polymer layer comprises 0.1% to 10% by weight of the at least one adhesion promoter based on the total weight of the at least one polymer layer. In some embodiments, the at least one polymer layer comprises 0.1% to 8% by weight of the at least one adhesion promoter based on the total weight of the at least one polymer layer. In some embodiments, the at least one polymer layer comprises 0.1% to 6% by weight of the at least one adhesion promoter based on the total weight of the at least one polymer layer. In some embodiments, the at least one polymer layer comprises 0.1% to 5% by weight of the at least one adhesion promoter based on the total weight of the at least one polymer layer. In some embodiments, the at least one polymer layer comprises 0.1% to 4% by weight of the at least one adhesion promoter based on the total weight of the at least one polymer layer. In some embodiments, the at least one polymer layer comprises 0.1% to 2% by weight of the at least one adhesion promoter based on the total weight of the at least one polymer layer. In some embodiments, the at least one polymer layer comprises 0.1% to 1% by weight of the at least one adhesion promoter based on the total weight of the at least one polymer layer. In some embodiments, the at least one polymer layer comprises 0.1% to 0.8% by weight of the at least one adhesion promoter based on the total weight of the at least one polymer layer. In some embodiments, the at least one polymer layer comprises 0.1% to 0.6% by weight of the at least one adhesion promoter based on the total weight of the at least one polymer layer. In some embodiments, the at least one polymer layer comprises 0.1% to 0.5% by weight of the at least one adhesion promoter based on the total weight of the at least one polymer layer. In some embodiments, the at least one polymer layer comprises 0.1% to 0.4% by weight of the at least one adhesion promoter based on the total weight of the at least one polymer layer. In some embodiments, the at least one polymer layer comprises 0.1% to 0.2% by weight of the at least one adhesion promoter based on the total weight of the at least one polymer layer.

In some embodiments, the at least one adhesion promoter comprises at least one of dichlorodimethyl silane, a chlorinated polyolefin, an organosilane, an organotitanate, a zircoaluminate, a zirconate, an acrylate, an aryl phosphate ester, an alkyl phosphate ester, an aryl alkyl phosphate ester, a metal organic, a silica, a fumed silica, N-(2-aminoethyl)-3-aminopropyltrimethoxysilane, vinyl tris(2-methoxyethoxy) silane, 3-methacryloxypropyltrimethoxysilane, 2-(3,4-epoxycyclohexyl)ethyl trimethoxysilane, 3-glycidoxypropyltrimethoxysilane, 3-glycidoxypropylmethyldiethoxysilane, N-(2-aminoethyl) 3-aminopropyltrimethoxysilane, 3-aminopropyltriethoxysilane, 3-(N-aminomethylbenzylamino) propyltrimethoxysilane, 3-mercaptopropyltrimethoxysilane, 3-aminopropyltris (methylethylketoxime) silane, 3-glycidoxy propyltriisopropenoxysilane, 3-glycidoxypropylmethyldiisopropenoxysilane, any reaction product thereof, or any combination thereof. In some embodiments, the adhesion promoter is a reaction product of dichlorodimethylsilane and a silica agent. In some embodiments, the silica agent comprises a fumed silica. In some embodiments, the at least one adhesion promoter comprises at least one of tetraethyl orthosilicate, aminopropyltrimethoxysilane, or any combination thereof.

In some embodiments, the at least one polymer layer is a foamed layer. In some embodiments, the at least one polymer layer comprises a closed cell foam. In some embodiments, the at least one polymer layer comprises an open cell foam.

In some embodiments, each of the at least one polymer layer has a thickness of 1 mil to 200 mils. In some embodiments, each of the at least one polymer layer has a thickness of 1 mil to 190 mils. In some embodiments, each of the at least one polymer layer has a thickness of 1 mil to 180 mils. In some embodiments, each of the at least one polymer layer has a thickness of 1 mil to 170 mils. In some embodiments, each of the at least one polymer layer has a thickness of 1 mil to 160 mils. In some embodiments, each of the at least one polymer layer has a thickness of 1 mil to 150 mils. In some embodiments, each of the at least one polymer layer has a thickness of 1 mil to 140 mils. In some embodiments, each of the at least one polymer layer has a thickness of 1 mil to 130 mils. In some embodiments, each of the at least one polymer layer has a thickness of 1 mil to 120 mils. In some embodiments, each of the at least one polymer layer has a thickness of 1 mil to 110 mils. In some embodiments, each of the at least one polymer layer has a thickness of 1 mil to 100 mils. In some embodiments, each of the at least one polymer layer has a thickness of 1 mil to 90 mils. In some embodiments, each of the at least one polymer layer has a thickness of 1 mil to 80 mils. In some embodiments, each of the at least one polymer layer has a thickness of 1 mil to 70 mils. In some embodiments, each of the at least one polymer layer has a thickness of 1 mil to 60 mils. In some embodiments, each of the at least one polymer layer has a thickness of 1 mil to 50 mils. In some embodiments, each of the at least one polymer layer has a thickness of 1 mil to 40 mils. In some embodiments, each of the at least one polymer layer has a thickness of 1 mil to 30 mils. In some embodiments, each of the at least one polymer layer has a thickness of 1 mil to 20 mils. In some embodiments, each of the at least one polymer layer has a thickness of 1 mil to 10 mils. In some embodiments, each of the at least one polymer layer has a thickness of 1 mil to 5 mils.

In some embodiments, each of the at least one polymer layer has a thickness of 5 mils to 200 mils. In some embodiments, each of the at least one polymer layer has a thickness of 10 mils to 200 mils. In some embodiments, each of the at least one polymer layer has a thickness of 20 mils to 200 mils. In some embodiments, each of the at least one polymer layer has a thickness of 30 mils to 200 mils. In some embodiments, each of the at least one polymer layer has a thickness of 40 mils to 200 mils. In some embodiments, each of the at least one polymer layer has a thickness of 50 mils to 200 mils. In some embodiments, each of the at least one polymer layer has a thickness of 60 mils to 200 mils. In some embodiments, each of the at least one polymer layer has a thickness of 70 mils to 200 mils. In some embodiments, each of the at least one polymer layer has a thickness of 80 mils to 200 mils. In some embodiments, each of the at least one polymer layer has a thickness of 90 mils to 200 mils. In some embodiments, each of the at least one polymer layer has a thickness of 100 mils to 200 mils. In some embodiments, each of the at least one polymer layer has a thickness of 110 mils to 200 mils. In some embodiments, each of the at least one polymer layer has a thickness of 120 mils to 200 mils. In some embodiments, each of the at least one polymer layer has a thickness of 130 mils to 200 mils. In some embodiments, each of the at least one polymer layer has a thickness of 140 mils to 200 mils. In some embodiments, each of the at least one polymer layer has a thickness of 150 mils to 200 mils. In some embodiments, each of the at least one polymer layer has a thickness of 160 mils to 200 mils. In some embodiments, each of the at least one polymer layer has a thickness of 170 mils to 200 mils. In some embodiments, each of the at least one polymer layer has a thickness of 180 mils to 200 mils. In some embodiments, each of the at least one polymer layer has a thickness of 190 mils to 200 mils.

In some embodiments, the at least one polymer layer is formed by coating, printing, spraying, depositing, dipping, brushing, or otherwise applying a formulation from which the at least one polymer layer is derived onto a surface of a substrate. In some embodiments, the at least one polymer layer is formed by extruding, molding, calendaring, or laminating the at least one polymer layer.

In some embodiments, the roofing membrane comprises a reinforcement layer.

In some embodiments, the reinforcement layer is embedded in the at least one polymer layer. In some embodiments, the reinforcement layer is located on a bottom surface of the at least one polymer layer. In some embodiments, the at least one polymer layer is located on a top surface of the reinforcement layer. In some embodiments, the at least one polymer layer directly contacts a top surface of the reinforcement layer. In some embodiments, the at least one polymer layer is located on a bottom surface of the reinforcement layer. In some embodiments, the at least one polymer layer directly contacts a bottom surface of the reinforcement layer. In some embodiments, the at least one polymer layer impregnates the reinforcement layer. In some embodiments, the reinforcement layer is located on a top surface of the at least one polymer layer. In some embodiments, the reinforcement layer is located between a first polymer layer and a second polymer layer. In some embodiments, the reinforcement layer directly contacts the first polymer layer and the second polymer layer. In some embodiments, an intervening layer is located between the reinforcement layer and the first polymer layer. In some embodiments, the intervening layer is located between the reinforcement layer and the second polymer layer.

In some embodiments, the reinforcement layer is a support layer. In some embodiments, the reinforcement layer comprises at least one of a mesh, a fabric, a fleece, a mat (a woven mat, an unwoven mat, etc.), a scrim, a coated scrim, a woven, a nonwoven, or any combination thereof. In some embodiments, the reinforcement layer comprises at least one of a spunbond mat, a spunlaced mat, an airlaid mat, a meltblown mat, or any combination thereof. In some embodiments, the reinforcement layer comprises a fibrous material, wherein the fibrous material comprises at least one of a natural fiber, a synthetic fiber, or any combination thereof. In some embodiments, the reinforcement layer comprises at least one of a polyolefin (e.g., at least one of a polyethylene, a polypropylene, any copolymer thereof, any blend thereof, or any combination thereof), a polyester, a polyamide, a glass, a fiberglass, or any combination thereof.

In some embodiments, the reinforcement layer has a thickness of 1 mil to 200 mils. In some embodiments, the reinforcement layer has a thickness of 10 mils to 200 mils. In some embodiments, the reinforcement layer has a thickness of 20 mils to 200 mils. In some embodiments, the reinforcement layer has a thickness of 30 mils to 200 mils. In some embodiments, the reinforcement layer has a thickness of 40 mils to 200 mils. In some embodiments, the reinforcement layer has a thickness of 50 mils to 200 mils. In some embodiments, the reinforcement layer has a thickness of 60 mils to 200 mils. In some embodiments, the reinforcement layer has a thickness of 70 mils to 200 mils. In some embodiments, the reinforcement layer has a thickness of 80 mils to 200 mils. In some embodiments, the reinforcement layer has a thickness of 90 mils to 200 mils. In some embodiments, the reinforcement layer has a thickness of 100 mils to 200 mils. In some embodiments, the reinforcement layer has a thickness of 110 mils to 200 mils. In some embodiments, the reinforcement layer has a thickness of 120 mils to 200 mils. In some embodiments, the reinforcement layer has a thickness of 130 mils to 200 mils. In some embodiments, the reinforcement layer has a thickness of 140 mils to 200 mils. In some embodiments, the reinforcement layer has a thickness of 150 mils to 200 mils. In some embodiments, the reinforcement layer has a thickness of 160 mils to 200 mils. In some embodiments, the reinforcement layer has a thickness of 170 mils to 200 mils. In some embodiments, the reinforcement layer has a thickness of 180 mils to 200 mils. In some embodiments, the reinforcement layer has a thickness of 190 mils to 200 mils.

In some embodiments, the reinforcement layer has a thickness of 1 mil to 190 mils. In some embodiments, the reinforcement layer has a thickness of 1 mil to 180 mils. In some embodiments, the reinforcement layer has a thickness of 1 mil to 170 mils. In some embodiments, the reinforcement layer has a thickness of 1 mil to 160 mils. In some embodiments, the reinforcement layer has a thickness of 1 mil to 150 mils. In some embodiments, the reinforcement layer has a thickness of 1 mil to 140 mils. In some embodiments, the reinforcement layer has a thickness of 1 mil to 130 mils. In some embodiments, the reinforcement layer has a thickness of 1 mil to 120 mils. In some embodiments, the reinforcement layer has a thickness of 1 mil to 110 mils. In some embodiments, the reinforcement layer has a thickness of 1 mil to 100 mils. In some embodiments, the reinforcement layer has a thickness of 1 mil to 90 mils. In some embodiments, the reinforcement layer has a thickness of 1 mil to 80 mils. In some embodiments, the reinforcement layer has a thickness of 1 mil to 70 mils. In some embodiments, the reinforcement layer has a thickness of 1 mil to 60 mils. In some embodiments, the reinforcement layer has a thickness of 1 mil to 50 mils. In some embodiments, the reinforcement layer has a thickness of 1 mil to 40 mils. In some embodiments, the reinforcement layer has a thickness of 1 mil to 30 mils. In some embodiments, the reinforcement layer has a thickness of 1 mil to 20 mils. In some embodiments, the reinforcement layer has a thickness of 1 mil to 10 mils.

In some embodiments, the roofing membrane comprises a release liner.

In some embodiments, the roofing membrane has a thickness of 10 mils to 500 mils. In some embodiments, the roofing membrane has a thickness of 10 mils to 475 mils. In some embodiments, the roofing membrane has a thickness of 10 mils to 450 mils. In some embodiments, the roofing membrane has a thickness of 10 mils to 425 mils. In some embodiments, the roofing membrane has a thickness of 10 mils to 400 mils. In some embodiments, the roofing membrane has a thickness of 10 mils to 375 mils. In some embodiments, the roofing membrane has a thickness of 10 mils to 350 mils. In some embodiments, the roofing membrane has a thickness of 10 mils to 325 mils. In some embodiments, the roofing membrane has a thickness of 10 mils to 300 mils. In some embodiments, the roofing membrane has a thickness of 10 mils to 275 mils. In some embodiments, the roofing membrane has a thickness of 10 mils to 250 mils. In some embodiments, the roofing membrane has a thickness of 10 mils to 225 mils. In some embodiments, the roofing membrane has a thickness of 10 mils to 200 mils. In some embodiments, the roofing membrane has a thickness of 10 mils to 175 mils. In some embodiments, the roofing membrane has a thickness of 10 mils to 150 mils. In some embodiments, the roofing membrane has a thickness of 10 mils to 125 mils. In some embodiments, the roofing membrane has a thickness of 10 mils to 100 mils. In some embodiments, the roofing membrane has a thickness of 10 mils to 75 mils. In some embodiments, the roofing membrane has a thickness of 10 mils to 50 mils. In some embodiments, the roofing membrane has a thickness of 10 mils to 25 mils.

In some embodiments, the roofing membrane has a thickness of 25 mils to 500 mils. In some embodiments, the roofing membrane has a thickness of 50 mils to 500 mils. In some embodiments, the roofing membrane has a thickness of 75 mils to 500 mils. In some embodiments, the roofing membrane has a thickness of 100 mils to 500 mils. In some embodiments, the roofing membrane has a thickness of 125 mils to 500 mils. In some embodiments, the roofing membrane has a thickness of 150 mils to 500 mils. In some embodiments, the roofing membrane has a thickness of 175 mils to 500 mils. In some embodiments, the roofing membrane has a thickness of 200 mils to 500 mils. In some embodiments, the roofing membrane has a thickness of 225 mils to 500 mils. In some embodiments, the roofing membrane has a thickness of 250 mils to 500 mils. In some embodiments, the roofing membrane has a thickness of 275 mils to 500 mils. In some embodiments, the roofing membrane has a thickness of 300 mils to 500 mils. In some embodiments, the roofing membrane has a thickness of 325 mils to 500 mils. In some embodiments, the roofing membrane has a thickness of 350 mils to 500 mils. In some embodiments, the roofing membrane has a thickness of 375 mils to 500 mils. In some embodiments, the roofing membrane has a thickness of 400 mils to 500 mils. In some embodiments, the roofing membrane has a thickness of 425 mils to 500 mils. In some embodiments, the roofing membrane has a thickness of 450 mils to 500 mils. In some embodiments, the roofing membrane has a thickness of 475 mils to 500 mils.

It will be appreciated that the description of roofing membranes above also applies to any of the roofing materials disclosed herein. In some embodiments, the roofing materials are free of asphalt.

Some embodiments relate to a roofing system. In some embodiments, the roofing system comprises a roofing substrate. In some embodiments, the roofing system comprises a first roofing membrane. In some embodiments, the roofing system comprises a second roofing membrane. In some embodiments, the first roofing membrane covers at least a first portion of the roofing substrate. In some embodiments, the second roofing membrane covers at least a second portion of the roofing substrate. In some embodiments, each of the first roofing membrane and the second roofing membrane has a top surface and a bottom surface. In some embodiments, at least a portion of the bottom surface of the second roofing membrane is adhered to at least a portion of the top surface of the first roofing membrane, so as to form an overlapping joint. In some embodiments, the overlapping joint does not comprise an adhesive located between the first roofing membrane and the second roofing membrane. In some embodiments, each of the first roofing membrane and the second roofing membrane comprises a crosslinked polymer. In some embodiments, the crosslinked polymer comprises at least one of a polysiloxane, a silyl-terminated polymer, or any combination thereof. In some embodiments, each of the first roofing membrane and the second roofing membrane comprises 1% to 30% by weight of a boron-containing compound based on a total weight of each of the first roofing membrane and the second roofing membrane.

In some embodiments, the roofing substrate comprises at least one of a roof deck, an underlayment, or any combination thereof.

In some embodiments, each of the first roofing membrane and the second roofing membrane comprises a reinforcement layer.

In some embodiments, the reinforcement layer comprises at least one of a fabric, a mesh, a woven mat, a nonwoven mat, or any combination thereof.

In some embodiments, at least a portion of the first roofing membrane directly contacts the first portion of the roofing substrate.

In some embodiments, at least a portion of the second roofing membrane directly contacts the second portion of the roofing substrate.

In some embodiments, at least one of the first roofing membrane, the second roofing membrane, or any combination thereof is secured to the roofing substrate by at least one mechanical fastener.

In some embodiments, the at least the portion of the bottom surface of the second roofing membrane directly contacts the at least the portion of the top surface of the first roofing membrane.

In some embodiments, the overlapping joint is a watertight seal.

In some embodiments, the boron-containing compound comprises at least one of a boric acid, a boronic acid, a pyroboric acid, a boronate ester, a borate ester, a borosiloxane oligomer, a borosiloxane polymer, a boric anhydride, a boride, or any combination thereof.

Some embodiments relate to a method of installation. In some embodiments, the method of installation comprises obtaining at least a first roofing membrane and a second roofing membrane. In some embodiments, each of the first roofing membrane and the second roofing membrane comprises a crosslinked polymer. In some embodiments, the crosslinked polymer comprises at least one of a polysiloxane, a silyl-terminated polymer, or any combination thereof. In some embodiments, each of the first roofing membrane and the second roofing membrane comprises 1% to 30% by weight of a boron-containing compound based on a total weight of each of the first roofing membrane and the second roofing membrane. In some embodiments, each of the first roofing membrane and the second roofing membrane has a top surface and a bottom surface. In some embodiments, the method of installation comprises installing the first roofing membrane on a roofing substrate, such that the first roofing membrane covers at least a first portion of the roofing substrate. In some embodiments, the method of installation comprises installing the second roofing membrane on the roofing substrate, such that the second roofing membrane covers at least a second portion of the roofing substrate. In some embodiments, the method of installation comprises adhering at least a portion of the bottom surface of the second roofing membrane to at least a portion of the top surface of the first roofing membrane, so as to form an overlapping joint. In some embodiments, the overlapping joint does not comprise an adhesive located between the first roofing membrane and the second roofing membrane.

In some embodiments, installing the first roofing membrane comprises fastening the first roofing membrane to the at least the first portion of the roofing substrate.

In some embodiments, installing the second roofing membrane comprises fastening the second roofing membrane to the at least the second portion of the roofing substrate.

In some embodiments, the method of installation further comprises obtaining a roll of a roofing membrane, unrolling the roll of the roofing membrane; and cutting the roofing membrane, so as to obtain the first roofing membrane and the second roofing membrane.

In some embodiments, each of the first roofing membrane and the second roofing membrane is covered by a release liner.

In some embodiments, the method of installation further comprises, prior to installing the first roofing membrane, removing the release liner from the first roofing membrane.

In some embodiments, the method of installation further comprises, prior to installing the second roofing membrane, removing the release liner from the second roofing membrane.

In some embodiments, at least a portion of the first roofing membrane directly contacts the first portion of the roofing substrate.

In some embodiments, at least a portion of the second roofing membrane directly contacts the second portion of the roofing substrate.

In some embodiments, the at least the portion of the bottom surface of the second roofing membrane directly contacts the at least the portion of the top surface of the first roofing membrane.

In some embodiments, the first roofing membrane and the second roofing membrane are secured to the roofing substrate by mechanical fasteners.

In some embodiments, the boron-containing compound comprises at least one of a boric acid, a boronic acid, a pyroboric acid, a boronate ester, a borate ester, a borosiloxane oligomer, a borosiloxane polymer, a boric anhydride, a boride, or any combination thereof.

FIG. 1 is a cross-section of a portion of a roofing system 100, according to some embodiments.

In some embodiments, the roofing system 100 comprises a roofing substrate 102. In some embodiments, the roofing substrate 102 comprises at least one of an asphaltic substrate, a plywood substrate, a glass substrate, a cellulosic substrate, an underlayment, a roofing membrane (reinforced or unreinforced), a roof deck, a photovoltaic (PV) panel, a modified bitumen (MODBIT) substrate, an oriented strand board (OSB), a roll good, a board (such as but not limited to at least one of a foam board (e.g., a polyisocyanurate (ISO) foam board), a cover board, or any combination thereof), a fire retardant board, a hail resistant board, a high density cover board, a cement board, concrete, a base sheet, a pipe, a chimney, a wax paper, a roof shingle, a mat, a fabric, a glass mat, a fiberglass mat, a woven mat, a nonwoven a fabric, a polyester mat, a scrim, a coated scrim, or any combination thereof.

In some embodiments, the roofing system 100 comprises at least two roofing materials. In some embodiments, the roofing system 100 comprises at least three roofing materials, at least four roofing materials, or more. For example, in some embodiments, the roofing system 100 comprises at least two roofing materials. In some embodiments, the at least two roofing materials are at least partially overlapping, so as to form an overlapping portion. In some embodiments, the at least two roofing materials are directly adhered to each other in the overlapping portion. In some embodiments, the roofing system 100 does not comprise an adhesive located between the at least two roofing materials, for example, at least in the overlapping portion. In some embodiments, an adhesive is not located between the at least two roofing materials in the overlapping portion. In some embodiments, the at least two roofing materials are not heat welded to each other in the overlapping portion.

In some embodiments, the roofing system 100 comprises a first roofing membrane 104.

In some embodiments, the first roofing membrane 104 covers at least a first portion of the roofing substrate 102. In some embodiments, the first roofing membrane 104 is installed on the roofing substrate 102. In some embodiments, the first roofing membrane 104 is secured to the roofing substrate 102. In some embodiments, the first roofing membrane 104 is fastened to the roofing substrate 102 by at least one mechanical fastener. In some embodiments, the first roofing membrane 104 is nailed to the roofing substrate 102. In some embodiments, the first roofing membrane 104 is adhered to the roofing substrate 102 (e.g., by an adhesive layer). In some embodiments, the first roofing membrane 104 is bonded to the roofing substrate 102. In some embodiments, the first roofing membrane 104 directly contacts the roofing substrate 102. In some embodiments, an intervening layer is located between the first roofing membrane 104 and the roofing substrate 102.

In some embodiments, the first roofing membrane 104 covers at least 1% of the first portion of the roofing substrate 102. In some embodiments, the first roofing membrane 104 covers at least 5% of the first portion of the roofing substrate 102. In some embodiments, the first roofing membrane 104 covers at least 10% of the first portion of the roofing substrate 102. In some embodiments, the first roofing membrane 104 covers at least 20% of the first portion of the roofing substrate 102. In some embodiments, the first roofing membrane 104 covers at least 30% of the first portion of the roofing substrate 102. In some embodiments, the first roofing membrane 104 covers at least 40% of the first portion of the roofing substrate 102. In some embodiments, the first roofing membrane 104 covers at least 50% of the first portion of the roofing substrate 102. In some embodiments, the first roofing membrane 104 covers at least 60% of the first portion of the roofing substrate 102. In some embodiments, the first roofing membrane 104 covers at least 70% of the first portion of the roofing substrate 102. In some embodiments, the first roofing membrane 104 covers at least 80% of the first portion of the roofing substrate 102. In some embodiments, the first roofing membrane 104 covers at least 90% of the first portion of the roofing substrate 102.

In some embodiments, the first roofing membrane 104 covers 1% to 90% of the first portion of the roofing substrate 102. In some embodiments, the first roofing membrane 104 covers 1% to 80% of the first portion of the roofing substrate 102. In some embodiments, the first roofing membrane 104 covers 1% to 70% of the first portion of the roofing substrate 102. In some embodiments, the first roofing membrane 104 covers 1% to 60% of the first portion of the roofing substrate 102. In some embodiments, the first roofing membrane 104 covers 1% to 50% of the first portion of the roofing substrate 102. In some embodiments, the first roofing membrane 104 covers 1% to 40% of the first portion of the roofing substrate 102. In some embodiments, the first roofing membrane 104 covers 1% to 30% of the first portion of the roofing substrate 102. In some embodiments, the first roofing membrane 104 covers 1% to 20% of the first portion of the roofing substrate 102. In some embodiments, the first roofing membrane 104 covers 1% to 10% of the first portion of the roofing substrate 102. In some embodiments, the first roofing membrane 104 covers 1% to 5% of the first portion of the roofing substrate 102.

In some embodiments, the first roofing membrane 104 covers 5% to 90% of the first portion of the roofing substrate 102. In some embodiments, the first roofing membrane 104 covers 10% to 90% of the first portion of the roofing substrate 102. In some embodiments, the first roofing membrane 104 covers 20% to 90% of the first portion of the roofing substrate 102. In some embodiments, the first roofing membrane 104 covers 30% to 90% of the first portion of the roofing substrate 102. In some embodiments, the first roofing membrane 104 covers 40% to 90% of the first portion of the roofing substrate 102. In some embodiments, the first roofing membrane 104 covers 50% to 90% of the first portion of the roofing substrate 102. In some embodiments, the first roofing membrane 104 covers 60% to 90% of the first portion of the roofing substrate 102. In some embodiments, the first roofing membrane 104 covers 70% to 90% of the first portion of the roofing substrate 102. In some embodiments, the first roofing membrane 104 covers 80% to 90% of the first portion of the roofing substrate 102.

It will be appreciated that any one or more of the roofing materials disclosed herein may be employed as the first roofing membrane 104, without departing from the scope of this disclosure. In some embodiments, for example, a first roofing material is used as the first roofing membrane 104.

In some embodiments, the roofing system comprises a second roofing membrane 106.

In some embodiments, the second roofing membrane 106 covers at least a second portion of the roofing substrate 102. In some embodiments, the second roofing membrane 106 is installed on the roofing substrate 102. In some embodiments, the second roofing membrane 106 is secured to the roofing substrate 102. In some embodiments, the second roofing membrane 106 is fastened to the roofing substrate 102 by at least one mechanical fastener. In some embodiments, the second roofing membrane 106 is nailed to the roofing substrate 102. In some embodiments, the second roofing membrane 106 is adhered to the roofing substrate 102 (e.g., by an adhesive layer). In some embodiments, the second roofing membrane 106 is bonded to the roofing substrate 102. In some embodiments, the second roofing membrane 106 directly contacts the roofing substrate 102. In some embodiments, an intervening layer is located between the second roofing membrane 106 and the roofing substrate 102.

In some embodiments, the second roofing membrane 106 covers at least 1% of the second portion of the roofing substrate 102. In some embodiments, the second roofing membrane 106 covers at least 5% of the second portion of the roofing substrate 102. In some embodiments, the second roofing membrane 106 covers at least 10% of the second portion of the roofing substrate 102. In some embodiments, the second roofing membrane 106 covers at least 20% of the second portion of the roofing substrate 102. In some embodiments, the second roofing membrane 106 covers at least 30% of the second portion of the roofing substrate 102. In some embodiments, the second roofing membrane 106 covers at least 40% of the second portion of the roofing substrate 102. In some embodiments, the second roofing membrane 106 covers at least 50% of the second portion of the roofing substrate 102. In some embodiments, the second roofing membrane 106 covers at least 60% of the second portion of the roofing substrate 102. In some embodiments, the second roofing membrane 106 covers at least 70% of the second portion of the roofing substrate 102. In some embodiments, the second roofing membrane 106 covers at least 80% of the second portion of the roofing substrate 102. In some embodiments, the second roofing membrane 106 covers at least 90% of the second portion of the roofing substrate 102.

In some embodiments, the second roofing membrane 106 covers 1% to 90% of the second portion of the roofing substrate 102. In some embodiments, the second roofing membrane 106 covers 1% to 80% of the second portion of the roofing substrate 102. In some embodiments, the second roofing membrane 106 covers 1% to 70% of the second portion of the roofing substrate 102. In some embodiments, the second roofing membrane 106 covers 1% to 60% of the second portion of the roofing substrate 102. In some embodiments, the second roofing membrane 106 covers 1% to 50% of the second portion of the roofing substrate 102. In some embodiments, the second roofing membrane 106 covers 1% to 40% of the second portion of the roofing substrate 102. In some embodiments, the second roofing membrane 106 covers 1% to 30% of the second portion of the roofing substrate 102. In some embodiments, the second roofing membrane 106 covers 1% to 20% of the second portion of the roofing substrate 102. In some embodiments, the second roofing membrane 106 covers 1% to 10% of the second portion of the roofing substrate 102. In some embodiments, the second roofing membrane 106 covers 1% to 5% of the second portion of the roofing substrate 102.

In some embodiments, the second roofing membrane 106 covers 5% to 90% of the second portion of the roofing substrate 102. In some embodiments, the second roofing membrane 106 covers 10% to 90% of the second portion of the roofing substrate 102. In some embodiments, the second roofing membrane 106 covers 20% to 90% of the second portion of the roofing substrate 102. In some embodiments, the second roofing membrane 106 covers 30% to 90% of the second portion of the roofing substrate 102. In some embodiments, the second roofing membrane 106 covers 40% to 90% of the second portion of the roofing substrate 102. In some embodiments, the second roofing membrane 106 covers 50% to 90% of the second portion of the roofing substrate 102. In some embodiments, the second roofing membrane 106 covers 60% to 90% of the second portion of the roofing substrate 102. In some embodiments, the second roofing membrane 106 covers 70% to 90% of the second portion of the roofing substrate 102. In some embodiments, the second roofing membrane 106 covers 80% to 90% of the second portion of the roofing substrate 102.

It will be appreciated that any one or more of the roofing materials disclosed herein may be employed as the second roofing membrane 106, without departing from the scope of this disclosure. In some embodiments, for example, a second roofing material is used as the second roofing membrane 106.

In some embodiments, at least a portion of a bottom surface of the second roofing membrane is adhered to at least a portion of a top surface of the first roofing membrane. In some embodiments, at least a portion of a bottom surface of the second roofing membrane is adhered to at least a portion of a top surface of the first roofing membrane, so as to form an overlapping portion of the first roofing membrane and the second roofing membrane. In some embodiments, the overlapping portion of the first roofing membrane and the second roofing membrane is an overlapping joint. In some embodiments, the overlapping portion of the first roofing membrane and the second roofing membrane is a watertight seal. In some embodiments, the overlapping portion of the first roofing membrane and the second roofing membrane does not comprise an adhesive located between the first roofing membrane and the second roofing membrane. In some embodiments, the overlapping portion of the first roofing membrane and the second roofing membrane comprises the second roofing membrane directly contacting the first roofing membrane.

In some embodiments, an end portion of the bottom surface of the second roofing membrane overlaps an end portion of the top surface of the first roofing membrane. In some embodiments, an edge portion of the bottom surface of the second roofing membrane overlaps an end portion of the top surface of the first roofing membrane. In some embodiments, an end portion of the bottom surface of the second roofing membrane overlaps an edge portion of the top surface of the first roofing membrane. In some embodiments, an edge portion of the bottom surface of the second roofing membrane overlaps an edge portion of the top surface of the first roofing membrane. In some embodiments, a selvage edge portion of the second roofing membrane overlaps a selvage edge portion of the first roofing membrane. In some embodiments, the overlapping portions directly contact each other.

In some embodiments, the bottom surface of the second roofing membrane covers 1% to 90% of the top surface of the first roofing membrane. In some embodiments, the bottom surface of the second roofing membrane covers 1% to 80% of the top surface of the first roofing membrane. In some embodiments, the bottom surface of the second roofing membrane covers 1% to 70% of the top surface of the first roofing membrane. In some embodiments, the bottom surface of the second roofing membrane covers 1% to 60% of the top surface of the first roofing membrane. In some embodiments, the bottom surface of the second roofing membrane covers 1% to 50% of the top surface of the first roofing membrane. In some embodiments, the bottom surface of the second roofing membrane covers 1% to 40% of the top surface of the first roofing membrane. In some embodiments, the bottom surface of the second roofing membrane covers 1% to 30% of the top surface of the first roofing membrane. In some embodiments, the bottom surface of the second roofing membrane covers 1% to 20% of the top surface of the first roofing membrane. In some embodiments, the bottom surface of the second roofing membrane covers 1% to 10% of the top surface of the first roofing membrane. In some embodiments, the bottom surface of the second roofing membrane covers 1% to 5% of the top surface of the first roofing membrane.

In some embodiments, the bottom surface of the second roofing membrane covers 5% to 90% of the top surface of the first roofing membrane. In some embodiments, the bottom surface of the second roofing membrane covers 10% to 90% of the top surface of the first roofing membrane. In some embodiments, the bottom surface of the second roofing membrane covers 20% to 90% of the top surface of the first roofing membrane. In some embodiments, the bottom surface of the second roofing membrane covers 30% to 90% of the top surface of the first roofing membrane. In some embodiments, the bottom surface of the second roofing membrane covers 40% to 90% of the top surface of the first roofing membrane. In some embodiments, the bottom surface of the second roofing membrane covers 50% to 90% of the top surface of the first roofing membrane. In some embodiments, the bottom surface of the second roofing membrane covers 60% to 90% of the top surface of the first roofing membrane. In some embodiments, the bottom surface of the second roofing membrane covers 70% to 90% of the top surface of the first roofing membrane. In some embodiments, the bottom surface of the second roofing membrane covers 80% to 90% of the top surface of the first roofing membrane.

In some embodiments, a peel strength between the at least two roofing membranes in the overlapping portion is 1 PLI to 20 PLI as measured according to ASTM D413. In some embodiments, a peel strength between the at least two roofing membranes in the overlapping portion is 1 PLI to 18 PLI as measured according to ASTM D413. In some embodiments, a peel strength between the at least two roofing membranes in the overlapping portion is 1 PLI to 16 PLI as measured according to ASTM D413. In some embodiments, a peel strength between the at least two roofing membranes in the overlapping portion is 1 PLI to 15 PLI as measured according to ASTM D413. In some embodiments, a peel strength between the at least two roofing membranes in the overlapping portion is 1 PLI to 14 PLI as measured according to ASTM D413. In some embodiments, a peel strength between the at least two roofing membranes in the overlapping portion is 1 PLI to 12 PLI as measured according to ASTM D413. In some embodiments, a peel strength between the at least two roofing membranes in the overlapping portion is 1 PLI to 10 PLI as measured according to ASTM D413. In some embodiments, a peel strength between the at least two roofing membranes in the overlapping portion is 1 PLI to 8 PLI as measured according to ASTM D413. In some embodiments, a peel strength between the at least two roofing membranes in the overlapping portion is 1 PLI to 6 PLI as measured according to ASTM D413. In some embodiments, a peel strength between the at least two roofing membranes in the overlapping portion is 1 PLI to 5 PLI as measured according to ASTM D413. In some embodiments, a peel strength between the at least two roofing membranes in the overlapping portion is 1 PLI to 4 PLI as measured according to ASTM D413.

In some embodiments, a peel strength between the at least two roofing membranes in the overlapping portion is 2 PLI to 20 PLI as measured according to ASTM D413. In some embodiments, a peel strength between the at least two roofing membranes in the overlapping portion is 4 PLI to 20 PLI as measured according to ASTM D413. In some embodiments, a peel strength between the at least two roofing membranes in the overlapping portion is 5 PLI to 20 PLI as measured according to ASTM D413. In some embodiments, a peel strength between the at least two roofing membranes in the overlapping portion is 6 PLI to 20 PLI as measured according to ASTM D413. In some embodiments, a peel strength between the at least two roofing membranes in the overlapping portion is 8 PLI to 20 PLI as measured according to ASTM D413. In some embodiments, a peel strength between the at least two roofing membranes in the overlapping portion is 10 PLI to 20 PLI as measured according to ASTM D413. In some embodiments, a peel strength between the at least two roofing membranes in the overlapping portion is 12 PLI to 20 PLI as measured according to ASTM D413. In some embodiments, a peel strength between the at least two roofing membranes in the overlapping portion is 14 PLI to 20 PLI as measured according to ASTM D413. In some embodiments, a peel strength between the at least two roofing membranes in the overlapping portion is 15 PLI to 20 PLI as measured according to ASTM D413. In some embodiments, a peel strength between the at least two roofing membranes in the overlapping portion is 16 PLI to 20 PLI as measured according to ASTM D413. In some embodiments, a peel strength between the at least two roofing membranes in the overlapping portion is 18 PLI to 20 PLI as measured according to ASTM D413.

Figure 2:
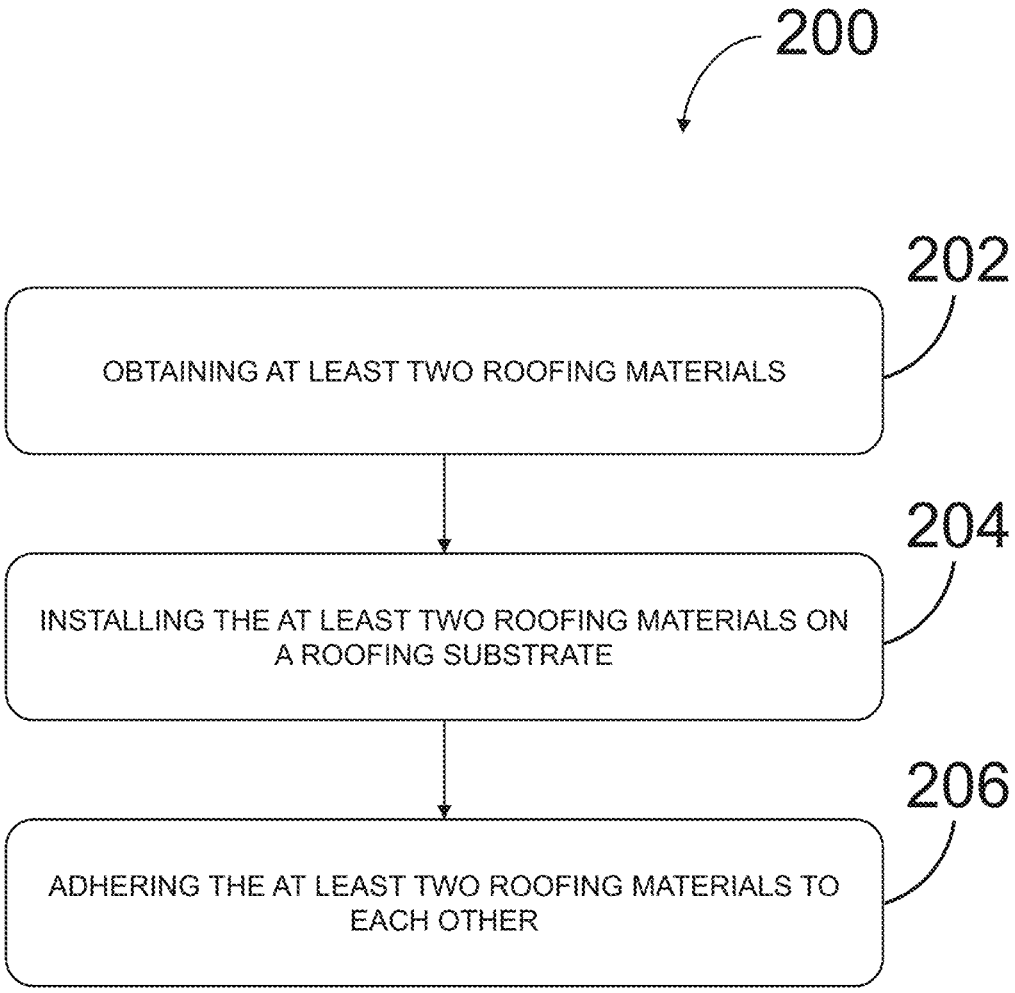
FIG. 2 is a flowchart of a method of installing a roofing system, according to some embodiments.

FIG. 2 is a flowchart of a method of installing 200 a roofing system (such as, for example, the roofing system 100 of FIG. 1), according to some embodiments. As shown in FIG. 2, the method of installing 200 comprises one or more of the following steps: obtaining 202 at least two roofing membranes; installing 204 the at least two roofing membranes on a roofing substrate; and adhering 206 the at least two roofing membranes to each other.

In some embodiments, the method of installing 200 comprises obtaining 202 at least two roofing membranes. For example, in some embodiments, the method of installing 200 comprises obtaining 202 at least a first roofing membrane and a second roofing membrane. In some embodiments, each of the first roofing membrane and the second roofing membrane comprises at least one polymer. In some embodiments, the at least one polymer comprises at least one of a polysiloxane, a silyl-terminated polymer, or any combination thereof. In some embodiments, each of the first roofing membrane and the second roofing membrane comprises a boron-containing compound. In some embodiments, the boron-containing compound comprises at least one of a boric acid, a boronic acid, a pyroboric acid, a boronate ester, a borate ester, a borosiloxane oligomer, a borosiloxane polymer, a boric anhydride, a boride, or any combination thereof. In some embodiments, the method of installing 200 comprises obtaining 202 at least three roofing membranes. For example, in some embodiments, the method of installing 200 comprises obtaining 202 at least a first roofing membrane, a second roofing membrane, and a third roofing membrane.

It will be appreciated that any of the first roofing membranes and the second roofing membranes disclosed herein may be used, without departing from the scope of this disclosure. It will also be appreciated that any one or more of the roofing materials disclosed herein may be employed as the first roofing membrane, without departing from the scope of this disclosure. It will further be appreciated that any one or more of the roofing materials disclosed herein may be employed as the second roofing membrane, without departing from the scope of this disclosure.

In some embodiments, the method of installing 200 comprises installing 204 the at least two roofing membranes on a roofing substrate. In some embodiments, the method of installing 200 comprises installing the at least two roofing membranes on a roofing substrate such that, when adhered to each other, the at least two roofing membranes are partially overlapping. In some embodiments, the method of installing 200 comprises installing 204 the first roofing membrane on a roofing substrate, such that the first roofing membrane covers at least a first portion of the roofing substrate. In some embodiments, the installing 204 comprises securing at least a portion of the first roofing membrane to the roofing substrate. In some embodiments, the installing 204 comprises fastening at least a portion of the first roofing membrane to the roofing substrate by the at least one mechanical fastener. In some embodiments, the installing 204 comprises nailing at least a portion of the first roofing membrane to the roofing substrate. In some embodiments, the installing 204 comprises adhering at least a portion of the first roofing membrane to the roofing substrate. In some embodiments, the installing 204 comprises bonding at least a portion of the first roofing membrane to the roofing substrate.

In some embodiments, the method of installing 200 comprises installing 204 the second roofing membrane on the roofing substrate, such that the second roofing membrane covers at least a second portion of the roofing substrate. In some embodiments, the installing 204 comprises securing at least a portion of the second roofing membrane to the roofing substrate. In some embodiments, the installing 204 comprises fastening at least a portion of the second roofing membrane to the roofing substrate by the at least one mechanical fastener. In some embodiments, the installing 204 comprises nailing at least a portion of the second roofing membrane to the roofing substrate. In some embodiments, the installing 204 comprises adhering at least a portion of the second roofing membrane to the roofing substrate. In some embodiments, the installing 204 comprises bonding at least a portion of the second roofing membrane to the roofing substrate. It will be appreciated that the method of installing 200 may comprise installing one or more additional roofing materials, optionally in overlapping relationship with the at least two roofing materials, without departing from the scope of this disclosure.

In some embodiments, the method of installing 200 comprises adhering 206 the at least two roofing membranes to each other, such that the at least two roofing membranes are partially overlapping. In some embodiments, the method of installing 200 comprises adhering 206 at least a portion of a bottom surface of the second roofing membrane to at least a portion of a top surface of the first roofing membrane, so as to form an overlapping joint. In some embodiments, the overlapping joint does not comprise an adhesive located between the first roofing membrane and the second roofing membrane. In some embodiments, the adhering 206 comprises contacting at least a portion of the bottom surface of the second roofing membrane to at least a portion of the top surface of the first roofing membrane, so as to form the overlapping joint. In some embodiments, the adhering 206 comprises bonding at least a portion of the bottom surface of the second roofing membrane to at least a portion of the top surface of the first roofing membrane, so as to form the overlapping joint. In some embodiments, the adhering 206 comprises heating at least a portion of the bottom surface of the second roofing membrane to at least a portion of the top surface of the first roofing membrane, so as to form the overlapping joint. In some embodiments, the adhering 206 comprises pressing at least a portion of the bottom surface of the second roofing membrane onto at least a portion of the top surface of the first roofing membrane, so as to form the overlapping joint. In some embodiments, the adhering 206 does not comprise heat welding the at least two roofing membranes to each other. In some embodiments, the adhering 206 does not comprise adhering the at least two roofing membranes to each other with an adhesive. It will be appreciated that the method of installing 200 may comprise adhering one or more additional roofing materials to the at least two roofing materials, optionally in overlapping relationship with the at least two roofing materials, without departing from the scope of this disclosure.

In some embodiments, the method of installing 200 a roofing system further comprises obtaining a roll of a roofing membrane; unrolling the roll of the roofing membrane; and cutting the roofing membrane, so as to obtain the first roofing membrane and the second roofing membrane. In some embodiments, when at least a portion of the first roofing membrane is covered by a release liner, the method of installing 200 a roofing system further comprises, prior to installing the first roofing membrane, removing the release liner from the first roofing membrane. In some embodiments, when at least a portion of the second roofing membrane is covered by a release liner, the method of installing 200 a roofing system further comprises, prior to installing the second roofing membrane, removing the release liner from the second roofing membrane.

In some embodiments, a method of installing comprises wrapping the roofing membrane around a roofing accessory and adhering a first end of the roofing membrane to a second end of the roofing membrane, wherein the second end is opposite the first end of the roofing membrane. In some embodiments, the roofing membrane directly contacts a surface of the roofing accessory. In some embodiments, the roofing accessory comprises at least one of a roofing membrane, a reinforced detailing membrane, an unreinforced detailing membrane, a T-joint patch, a vent boot, a penetration pocket, a universal corner, a cover tape, a pipe boot, a split pipe boot, a square tube wrap, a pourable sealer pocket, a corner reinforcement, a roof penetration, or any combination thereof. It will be appreciated that other roofing accessories may be used herein without departing from the scope of this disclosure.

Figure 3:
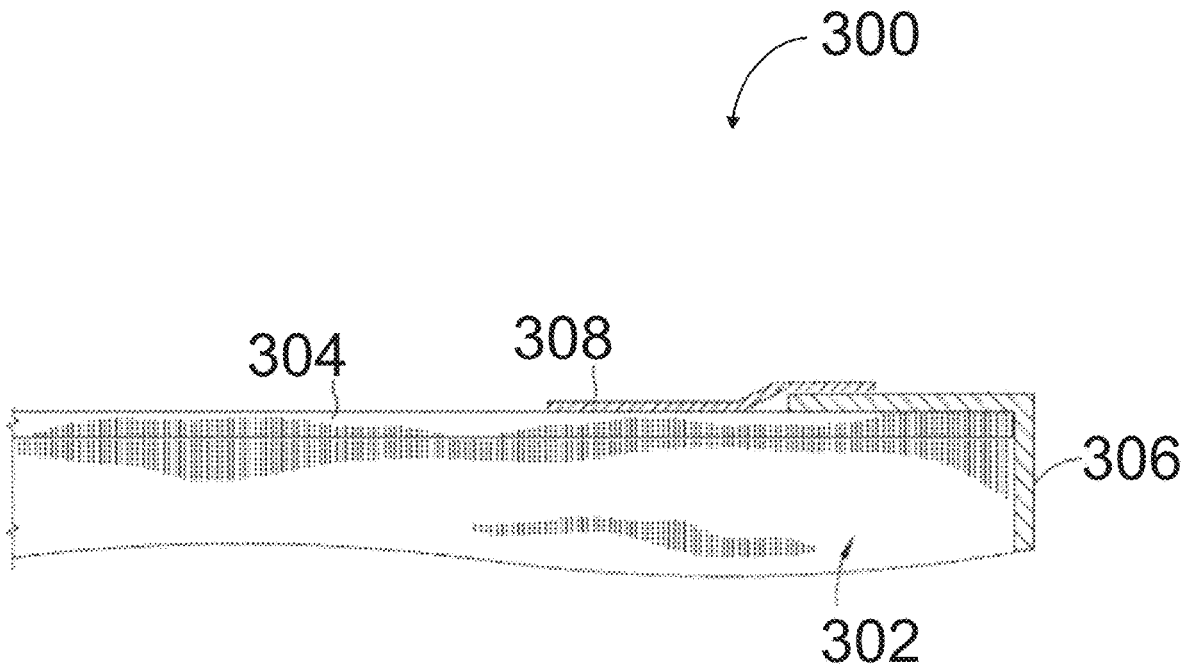
FIG. 3 is a cross-section of a portion of a roofing system, according to some embodiments.

FIG. 3 is a cross-section of a portion of a roofing system 300, according to some embodiments. As shown in FIG. 3, in some embodiments, the roofing system 300 comprises a roofing substrate 302. In some embodiments, the roofing system 300 comprises a roofing membrane 304. In some embodiments, the roofing membrane 304 is located on the roofing substrate 302. In some embodiments, the roofing membrane 304 comprises any one or more of the roofing membranes disclosed herein. For example, in some embodiments, the roofing membrane 304 comprises a crosslinked polymer. In some embodiments, the roofing membrane 304 comprises 1% to 30% by weight of a boron-containing compound based on a total weight of the roofing membrane 304. In some embodiments, the roofing system 300 comprises an edge metal flashing 306. In some embodiments, the edge metal flashing 306 covers at least a portion of the roofing membrane 304. In some embodiments, the roofing system 300 comprises a cover tape 308. In some embodiments, the cover tape 308 covers at least a portion of the edge metal flashing 306. In some embodiments, the cover tape 308 covers at least a portion of the roofing membrane 304. In some embodiments, the cover tape 308 is directly adhered to the at least a portion of the roofing membrane 304. In some embodiments, the cover tape 308 comprises a crosslinked polymer. In some embodiments, the cover tape 308 comprises 1% to 30% by weight of a boron-containing compound based on a total weight of the cover tape 308. In some embodiments, the cover tape 308 is not heat welded to the at least a portion of the roofing membrane 304. In some embodiments, the roofing system 300 does not comprise an adhesive located between the cover tape 308 and the at least a portion of the roofing membrane 304.

Figure 4:
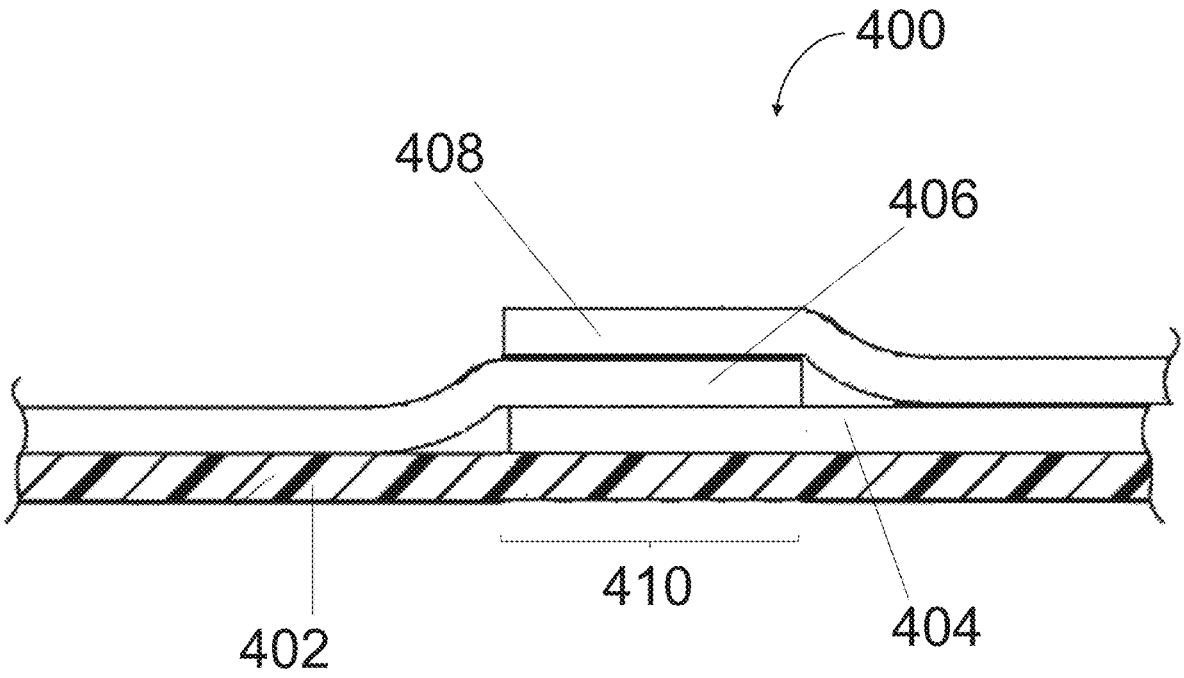
FIG. 4 is a cross-section of a portion of a roofing system, according to some embodiments.

FIG. 4 is a cross-section of a portion of a roofing system 400, according to some embodiments. In some embodiments, the roofing system 400 depicted in FIG. 4 illustrates a T-joint. In some embodiments, a T-joint is a joint formed by the intersection or overlapping of three or four roofing membranes. As shown in FIG. 4, in some embodiments, the roofing system 400 comprises a roofing substrate 402. In some embodiments, the roofing system 400 comprises at least three roofing membranes. In some embodiments, each of the at least three roofing membranes comprises any one or more of the roofing membranes disclosed herein. In some embodiments, the at least three roofing membranes are located on the roofing substrate 402. In some embodiments, the at least three roofing membranes comprises at least a first roofing membrane 404, a second roofing membrane 406, and a third roofing membrane 408. In some embodiments, the at least three roofing membranes are partially overlapping, so as to form an overlapping portion 410. In some embodiments, the at least three roofing membranes are directly adhered to each other in the overlapping portion 410. In some embodiments, in the overlapping portion 410, the second roofing membrane 406 is located between the first roofing membrane 404 and the third roofing membrane 408. In some embodiments, in the overlapping portion 410, the second roofing membrane 406 is directly adhered the first roofing membrane 404. In some embodiments, in the overlapping portion 410, the second roofing membrane 406 is directly adhered to the third roofing membrane 408. In some embodiments, each of the at least three roofing membranes independently comprises a crosslinked polymer. In some embodiments, each of the at least three roofing membranes independently comprises 1% to 30% by weight of a boron-containing compound based on a total weight of each of the at least three roofing membranes.

In some embodiments, the roofing system 400 does not comprise an adhesive in the overlapping portion 410. In some embodiments, an adhesive is not located between the at least three roofing membranes in the overlapping portion 410. In some embodiments, the at least three roofing membranes are not heat welded to each other in in the overlapping portion 410. For example, in some embodiments, the roofing system 400 does not comprise an adhesive located between the first roofing membrane 404 and the second roofing membrane 406, for example, at least in the overlapping portion 410. In some embodiments, the roofing system 400 does not comprise an adhesive located between the second roofing membrane 406 and the third roofing membrane 408, for example, at least in the overlapping portion 410. In some embodiments, at least in the overlapping portion, the first roofing membrane 404 is not heat welded to the second roofing membrane 406. In some embodiments, at least in the overlapping portion, the second roofing membrane 406 is not heat welded to the third roofing membrane 408. Although not shown, in some embodiments, the roofing system 400 further comprises a T-joint patch located on the overlapping portion 410. In some embodiments, the T-joint patch comprises a crosslinked polymer. In some embodiments, the T-joint patch comprises 1% to 30% by weight of a boron-containing compound based on a total weight of the T-joint patch.

In some embodiments, a peel strength between the at least three roofing membranes in the overlapping portion is 1 PLI to 20 PLI as measured according to ASTM D413. In some embodiments, a peel strength between the at least three roofing membranes in the overlapping portion is 1 PLI to 18 PLI as measured according to ASTM D413. In some embodiments, a peel strength between the at least three roofing membranes in the overlapping portion is 1 PLI to 16 PLI as measured according to ASTM D413. In some embodiments, a peel strength between the at least three roofing membranes in the overlapping portion is 1 PLI to 15 PLI as measured according to ASTM D413. In some embodiments, a peel strength between the at least three roofing membranes in the overlapping portion is 1 PLI to 14 PLI as measured according to ASTM D413. In some embodiments, a peel strength between the at least three roofing membranes in the overlapping portion is 1 PLI to 12 PLI as measured according to ASTM D413. In some embodiments, a peel strength between the at least three roofing membranes in the overlapping portion is 1 PLI to 10 PLI as measured according to ASTM D413. In some embodiments, a peel strength between the at least three roofing membranes in the overlapping portion is 1 PLI to 8 PLI as measured according to ASTM D413. In some embodiments, a peel strength between the at least three roofing membranes in the overlapping portion is 1 PLI to 6 PLI as measured according to ASTM D413. In some embodiments, a peel strength between the at least three roofing membranes in the overlapping portion is 1 PLI to 5 PLI as measured according to ASTM D413. In some embodiments, a peel strength between the at least three roofing membranes in the overlapping portion is 1 PLI to 4 PLI as measured according to ASTM D413.

In some embodiments, a peel strength between the at least three roofing membranes in the overlapping portion is 2 PLI to 20 PLI as measured according to ASTM D413. In some embodiments, a peel strength between the at least three roofing membranes in the overlapping portion is 4 PLI to 20 PLI as measured according to ASTM D413. In some embodiments, a peel strength between the at least three roofing membranes in the overlapping portion is 5 PLI to 20 PLI as measured according to ASTM D413. In some embodiments, a peel strength between the at least three roofing membranes in the overlapping portion is 6 PLI to 20 PLI as measured according to ASTM D413. In some embodiments, a peel strength between the at least three roofing membranes in the overlapping portion is 8 PLI to 20 PLI as measured according to ASTM D413. In some embodiments, a peel strength between the at least three roofing membranes in the overlapping portion is 10 PLI to 20 PLI as measured according to ASTM D413. In some embodiments, a peel strength between the at least three roofing membranes in the overlapping portion is 12 PLI to 20 PLI as measured according to ASTM D413. In some embodiments, a peel strength between the at least three roofing membranes in the overlapping portion is 14 PLI to 20 PLI as measured according to ASTM D413. In some embodiments, a peel strength between the at least three roofing membranes in the overlapping portion is 15 PLI to 20 PLI as measured according to ASTM D413. In some embodiments, a peel strength between the at least three roofing membranes in the overlapping portion is 16 PLI to 20 PLI as measured according to ASTM D413. In some embodiments, a peel strength between the at least three roofing membranes in the overlapping portion is 18 PLI to 20 PLI as measured according to ASTM D413.

Figure 5:
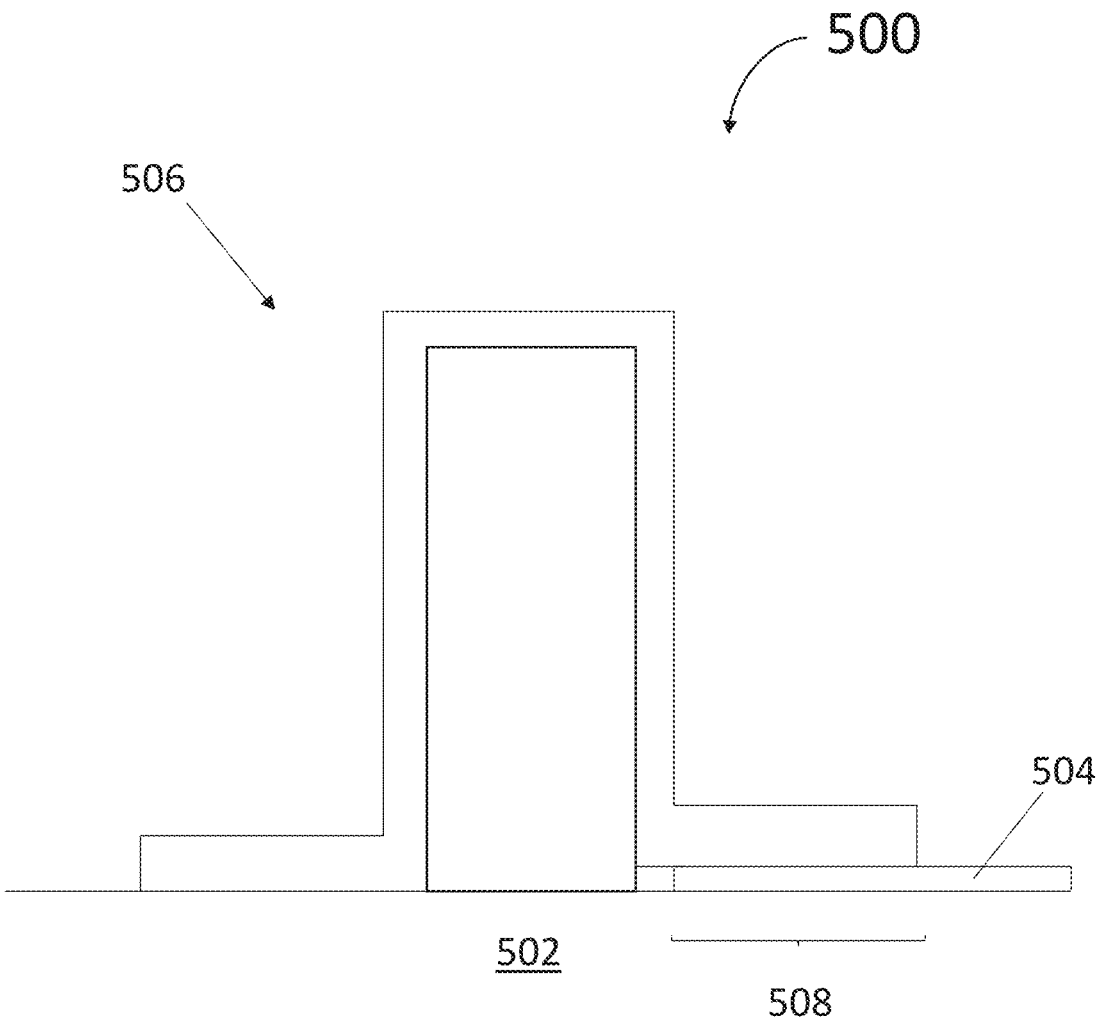
FIG. 5 is a cross-section of a portion of a roofing system, according to some embodiments.

FIG. 5 is a cross-section of a portion of a roofing system 500, according to some embodiments. As shown in FIG. 5, in some embodiments, the roofing system 500 comprises a roofing substrate 502. In some embodiments, the roofing system 500 comprises a roofing membrane 504. In some embodiments, the roofing membrane 504 is located on the roofing substrate 502. In some embodiments, the roofing membrane 504 comprises any one or more of the membranes disclosed herein. In some embodiments, the roofing membrane 504 comprises a crosslinked polymer. In some embodiments, the roofing membrane 504 comprises 1% to 30% by weight of a boron-containing compound based on a total weight of the roofing membrane 504. In some embodiments, the roofing system 500 comprises a roofing accessory 506. In some embodiments, the roofing accessory 506 covers at least a portion of the roofing membrane 504. In some embodiments, the roofing accessory 506 covers at least a portion of the roofing substrate 502. In some embodiments, the roofing accessory 506 is directly adhered to the at least a portion of the roofing membrane 504. In some embodiments, the roofing accessory 506 comprises any one or more of the roofing accessories disclosed herein. For example, in some embodiments, the roofing accessory 506 comprises a crosslinked polymer. In some embodiments, the roofing accessory 506 comprises 1% to 30% by weight of a boron-containing compound based on a total weight of the roofing accessory 506. In some embodiments, the roofing system 500 does not comprise an adhesive located between the roofing accessory 506 and the roofing membrane 504, for example, at least in the overlapping portion 508. In some embodiments, the roofing accessory 506 is not heat welded to the roofing substrate 504.

Example 1

A formulation comprising 5% by weight of boric acid, 5% by weight of a silanol terminated fluid (viscosity 750 cp at 25° C.), and 2% by weight of vinyltrimethoxysilane was prepared by combined the foregoing and mixing the foregoing under heating at 120° C. to obtain a mixture. Subsequently, 72% by weight of a liquid silicone rubber resin, 5% by weight of a polydimethylsiloxane fluid (viscosity 100 cst at 25° C.), 6% by weight of a fumed silica, and 4% by weight of a rutile titanium dioxide pigment were added to the mixture and mixed in a PolyLab mixer. Thereafter, 1% by weight of 2,4-dichlorobenzoyl peroxide in polydimethylsiloxane were added to the mixture and mixed at a temperature of less than 60° C. to obtain a sample membrane (Sample A). All weight percentages are based on a total weight of the final mixture (after all components have been added).

Example 2

A formulation comprising 5% by weight of boric acid, 5% by weight of a silanol terminated fluid (viscosity 750 cp at 25° C.), and 2% by weight of aminopropyltrimethoxysilane was prepared by combined the foregoing and mixing the foregoing under heating at 120° C. to obtain a mixture. Subsequently, 72% by weight of a liquid silicone rubber resin, 5% by weight of a polydimethylsiloxane fluid (viscosity 100 cst at 25° C.), 6% by weight of a fumed silica, and 4% by weight of a rutile titanium dioxide pigment were added to the mixture and mixed in a PolyLab mixer. Thereafter, 1% by weight of 2,4-dichlorobenzoyl peroxide in polydimethylsiloxane were added to the mixture and mixed at a temperature of less than 60° C. to obtain a sample membrane (Sample B). All weight percentages are based on a total weight of the final mixture (after all components have been added).

Example 3

Figure 6:
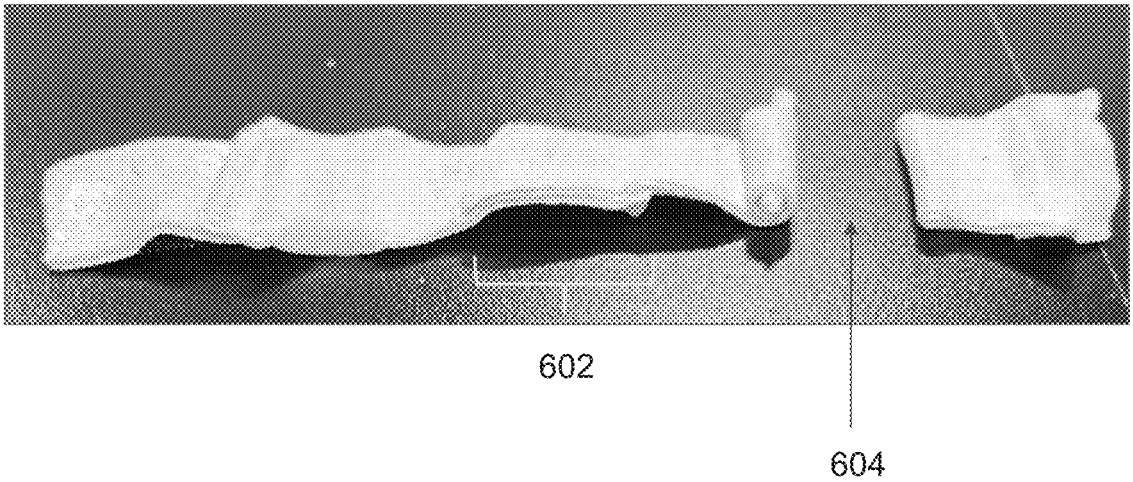
FIG. 6 is a photograph depicting the results of testing according to ASTM D2370, according to some embodiments.

Sample A was cut into two identical 1-inch-wide membranes and lightly pressed together at the ends so as to adhere the two membranes together with 1 inch overlap. The adhered membranes were submitted for testing according to ASTM D2370 Tensile and Elongation test. The adhered membranes broke apart or failed at 1.49 lbf/in due to membrane failure. That is, the adhered portion of the membranes remained intact, while the non-adhered portion of the membrane failed. This indicated that the adhered portion or overlapping joint had a stronger mechanical strength than the membrane itself. FIG. 6 is a photograph depicting the results of testing according to ASTM D2370, according to some embodiments. As shown in FIG. 6, the adhered portion or overlapping joint 602 remained intact, whereas the membrane failed at breakpoint 604 due to tensile stress.

Example 4

Sample B was cut into two identical 1-inch-wide membranes and lightly pressed together at the ends so as to adhere the two membranes together with 1 inch overlap. The adhered membranes were submitted for testing according to ASTM D2370 Tensile and Elongation test. The adhered membranes broke apart or failed at 2.36 lbf/in due to membrane failure. That is, the adhered portion of the membranes remained intact, while the non-adhered portion of the membrane failed. This indicated that the adhered portion or overlapping joint had a stronger mechanical strength than the membrane itself.

What is claimed is:

1. A roofing system comprising:
a roofing substrate; and
at least two roofing membranes,
wherein the at least two roofing membranes are located on the roofing substrate;
wherein the at least two roofing membranes are partially overlapping, so as to form an overlapping portion;
wherein each of the at least two roofing membranes independently comprises:
30% to 90% by weight of a crosslinked polymer,
wherein the crosslinked polymer comprises at least one of a polysiloxane, a silyl-terminated polymer, or any combination thereof;
1% to 30% by weight of a silicone fluid; and
1% to 15% by weight of a boron-containing compound,
wherein the boron-containing compound comprises at least one of a boric acid, a boronic acid, a pyroboric acid, a boronate ester, a borate ester, a borosiloxane oligomer, a borosiloxane polymer, a boric anhydride, a boride, or any combination thereof.

2. The roofing system of claim 1, wherein the roofing substrate comprises at least one of a roof deck, an underlayment, or any combination thereof.

3. The roofing system of claim 1, wherein the at least two roofing membranes are directly adhered to each other in the overlapping portion.

4. The roofing system of claim 1, wherein an adhesive is not located between the at least two roofing membranes in the overlapping portion.

5. The roofing system of claim 1, wherein the at least two roofing membranes are not heat welded together in the overlapping portion.

6. The roofing system of claim 1, wherein at least one of the at least two roofing membranes is a liquid applied roofing membrane.

7. The roofing system of claim 1, wherein at least one of the at least two roofing membranes is a roofing accessory.

8. A roofing system comprising:
a roofing substrate; and
at least three roofing membranes,
wherein the at least three roofing membranes are located on the roofing substrate;
wherein the at least three roofing membranes are partially overlapping, so as to form an overlapping portion;

wherein each of the at least three roofing membranes independently comprises:

30% to 90% by weight of a crosslinked polymer, wherein the crosslinked polymer comprises at least one of a polysiloxane, a silyl-terminated polymer, or any combination thereof;

1% to 30% by weight of a silicone fluid; and

1% to 15% by weight of a boron-containing compound, wherein the boron-containing compound comprises at least one of a boric acid, a boronic acid, a pyroboric acid, a boronate ester, a borate ester, a borosiloxane oligomer, a borosiloxane polymer, a boric anhydride, a boride, or any combination thereof.

9. The roofing system of claim 8, wherein the roofing substrate comprises at least one of a roof deck, an underlayment, or any combination thereof.

10. The roofing system of claim 8, wherein the at least three roofing membranes are directly adhered to each other in the overlapping portion.

11. The roofing system of claim 8, wherein an adhesive is not located between the at least three roofing membranes in the overlapping portion.

12. The roofing system of claim 8, wherein the at least three roofing membranes are not heat welded to each other in the overlapping portion.

13. A method of installation comprising:

obtaining at least two roofing membranes, wherein each of the at least two roofing membranes independently comprises:

30% to 90% by weight of a crosslinked polymer, wherein the crosslinked polymer comprises at least one of a polysiloxane, a silyl-terminated polymer, or any combination thereof;

1% to 30% by weight of a silicone fluid; and

1% to 15% by weight of a boron-containing compound, wherein the boron-containing compound comprises at least one of a boric acid, a boronic acid, a pyroboric acid, a boronate ester, a borate ester, a borosiloxane oligomer, a borosiloxane polymer, a boric anhydride, a boride, or any combination thereof;

installing the at least two roofing membranes on a roofing substrate, such that the at least two roofing membranes are partially overlapping in an overlapping portion; and adhering the at least two roofing membranes to each other in the overlapping portion.

14. The method of claim 13, wherein the adhering does not comprise heat welding the at least two roofing membranes to each other; wherein the adhering does not comprise adhering the at least two roofing membranes to each other with an adhesive.

* * * * *